US011392058B2

(12) United States Patent
Kim et al.

(10) Patent No.: US 11,392,058 B2
(45) Date of Patent: Jul. 19, 2022

(54) TONER REFILLING PORTION OF DEVELOPMENT CARTRIDGE TO PROVIDE FEEDBACK INDICATING INLET SHUTTER POSITION

(71) Applicant: HEWLETT-PACKARD DEVELOPMENT COMPANY, L.P., Spring, TX (US)

(72) Inventors: Seung il Kim, Vancouver, WA (US); Jiwon Moon, Suwon-si (KR); Yongnam Ahn, Suwon-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/273,374

(22) PCT Filed: May 28, 2019

(86) PCT No.: PCT/US2019/034148
§ 371 (c)(1),
(2) Date: Mar. 4, 2021

(87) PCT Pub. No.: WO2020/242453
PCT Pub. Date: Dec. 3, 2020

(65) Prior Publication Data

US 2021/0349412 A1 Nov. 11, 2021

(51) Int. Cl.
*G03G 15/08* (2006.01)
*G03G 21/16* (2006.01)

(52) U.S. Cl.
CPC ..... *G03G 15/0886* (2013.01); *G03G 15/0868* (2013.01); *G03G 15/0872* (2013.01); *G03G 21/1652* (2013.01)

(58) Field of Classification Search
None
See application file for complete search history.

(56) References Cited

U.S. PATENT DOCUMENTS

| | | | | |
|---|---|---|---|---|
| 7,574,160 | B2 | 8/2009 | Jung et al. | |
| 8,346,105 | B2 | 1/2013 | Takahashi et al. | |
| 10,126,681 | B2 | 11/2018 | Nishiyama | |
| 2009/0092415 | A1* | 4/2009 | Murakami | G03G 15/0855 399/119 |

(Continued)

FOREIGN PATENT DOCUMENTS

| | | | |
|---|---|---|---|
| DE | 69928880 | T2 | 6/2006 |
| JP | 3450757 | B2 | 9/2003 |

(Continued)

*Primary Examiner* — Victor Verbitsky
(74) *Attorney, Agent, or Firm* — Trop Pruner & Hu, P.C.

(57) ABSTRACT

A development cartridge which is mountable in an image forming apparatus includes a toner container portion to store toner and a toner refilling portion to receive, from a toner refill cartridge mountable to the toner refilling portion, toner to be stored in the toner container portion. The toner refilling portion includes an inlet shutter rotatable to an inlet position at which the toner is capable of being received by the toner refilling portion from the toner refill cartridge, and a shutter protrusion provided on a surface of the inlet shutter to, while the inlet shutter is rotated, contact an object and cause feedback indicating the inlet shutter is rotated to the inlet position.

19 Claims, 27 Drawing Sheets

(56) References Cited

U.S. PATENT DOCUMENTS

2016/0202636 A1* 7/2016 Koseki ..... G03G 21/105
399/358

FOREIGN PATENT DOCUMENTS

| | | |
|---|---|---|
| JP | 2005157029 | 6/2005 |
| JP | 2006113114 | 4/2006 |
| JP | 2006221079 | 8/2006 |
| JP | 2008076634 | 4/2008 |
| JP | 5594396 | 10/2014 |

* cited by examiner

TONER REFILLING PORTION OF DEVELOPMENT CARTRIDGE TO PROVIDE FEEDBACK INDICATING INLET SHUTTER POSITION

BACKGROUND

An image forming apparatus using an electrophotographic method supplies toner to an electrostatic latent image formed on a photoreceptor to form a visible toner image on the photoconductor, transfers the toner image to a printing medium via an intermediate transfer medium or directly to a printing medium, and then fixes the transferred toner image on the printing medium.

A development cartridge contains the toner, and supplies toner to the electrostatic latent image formed on the photoconductor to form a visible toner image. When the toner contained in the development cartridge is exhausted, the development cartridge is removed from a body of the image forming apparatus, and a new development cartridge may be mounted on a main body of the image forming apparatus. The development cartridge may also be refilled with a new toner by using a toner refill kit (toner refill cartridge).

DETAILED DESCRIPTION

Figure 1:
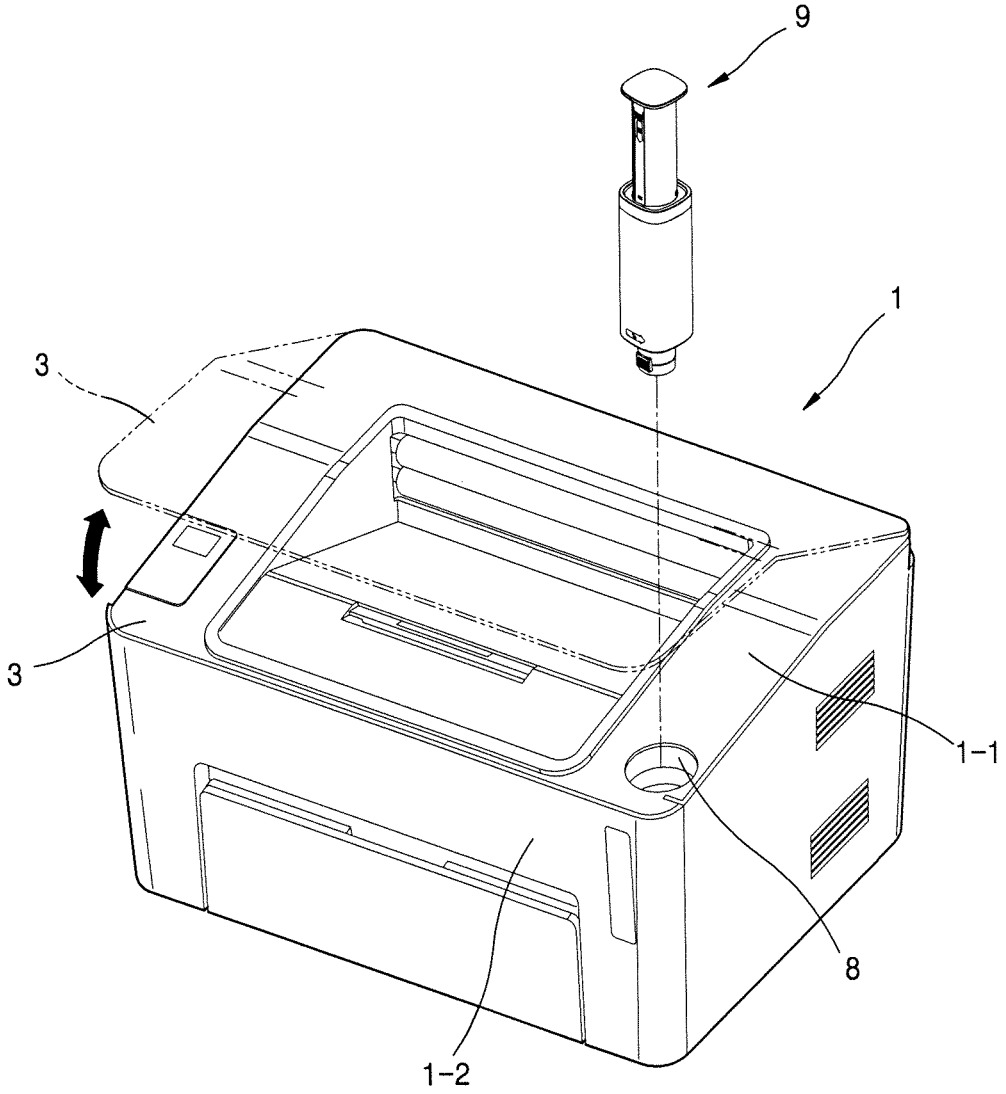
FIG. 1 is a schematic perspective view of the exterior of an electrophotographic image forming apparatus according to an example.

Reference will now be made in detail to examples, examples of which are illustrated in the accompanying drawings. The same reference numerals are used to denote the same elements, and repeated descriptions thereof will be omitted.

Figure 2:
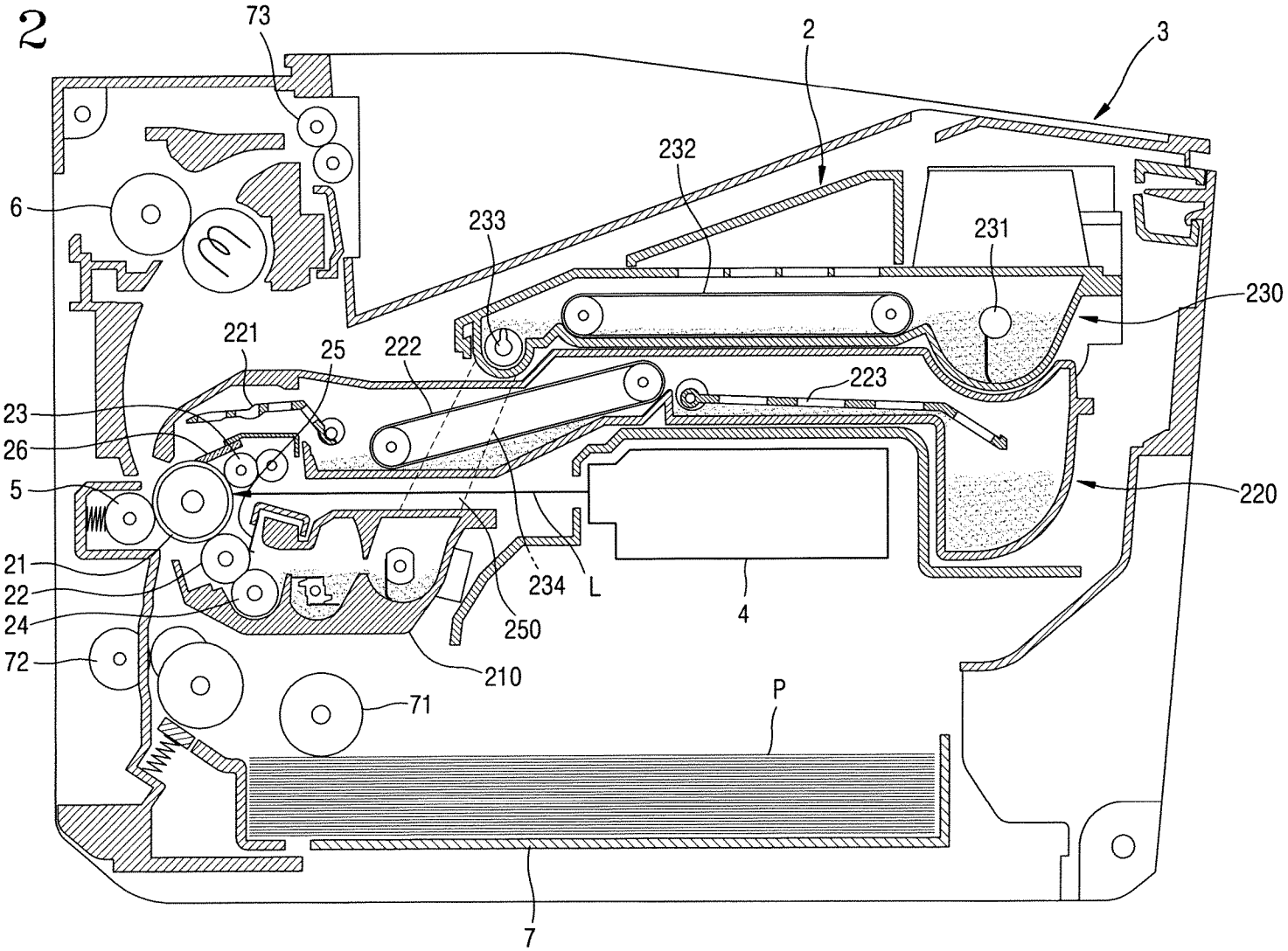
FIG. 2 is a schematic structural diagram of the electrophotographic image forming apparatus of FIG. 1 according to an example.
Figure 3:
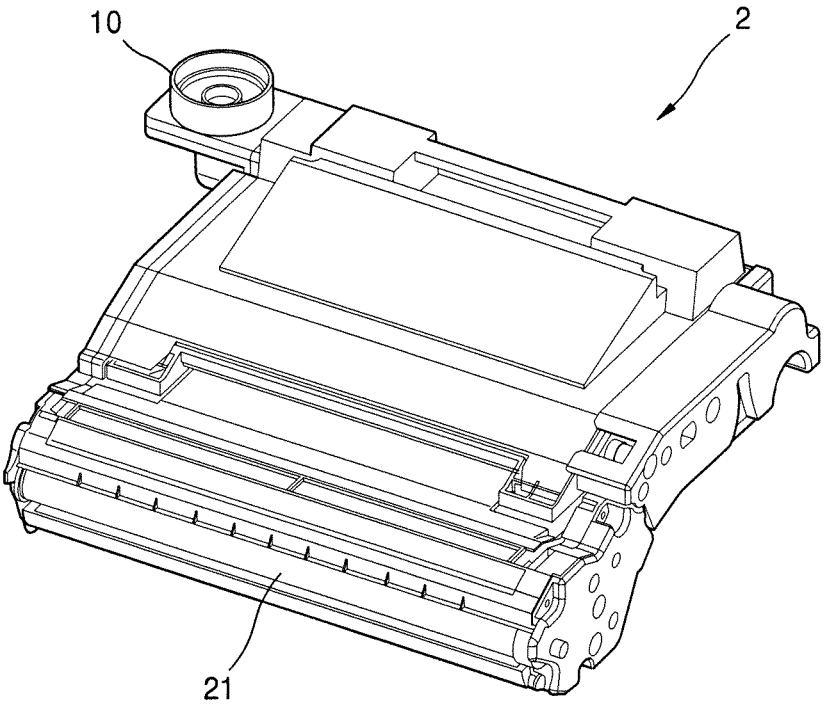
FIG. 3 is a perspective view of a development cartridge included in the electrophotographic image forming apparatus illustrated in FIG. 1, according to an example.

FIG. 1 is a schematic perspective view of the exterior of an electrophotographic image forming apparatus according to an example. FIG. 2 is a schematic structural diagram of the electrophotographic image forming apparatus of FIG. 1 according to an example. FIG. 3 is a perspective view of a development cartridge included in the electrophotographic image forming apparatus illustrated in FIG. 1, according to an example.

Referring to FIGS. 1, 2, and 3, the image forming apparatus may include a main body 1 and a development cartridge 2 that is attachable to/detachable from the main body 1. A door 3 may be provided in the main body 1. The door 3 opens or closes a portion of the main body 1. While the door 3 opening an upper portion of the main body 1 is illustrated in FIG. 1, a door opening a side portion or a front portion of the main body 1 may be included as needed. The development cartridge 2 may be mounted to or removed from the main body 1 by opening the door 3.

The main body 1 may include a communicating portion 8 such that the development cartridge 2 accesses from outside the main body 1 a toner refilling portion 10 in a state in which the development cartridge 2 is mounted on the main body 1. The communicating portion 8 may be provided at a position close to a front surface 1-2 of the main body 1. Since the front surface 1-2 faces the user, the user may easily access the communication portion 8. Therefore, a toner refilling operation using a toner refill cartridge 9 may be easily performed through the communicating portion 8. The communicating portion 8 may be provided on an upper surface 1-1 of the main body 1. The toner refilling portion 10 may be provided under the communicating portion 8. The communicating portion 8 and the toner refilling portion 10 may be aligned in a vertical direction. The toner refill cartridge 9 may access the toner refilling portion 10 from above the main body 1 through the communicating portion 8.

A photosensitive drum 21 is an example of a photoconductor on which an electrostatic latent image is formed, and may include a cylindrical metal pipe and a photoconductive photosensitive layer formed on an outer circumference of the metal pipe. A charging roller 23 is an example of a charger that charges a surface of the photosensitive drum 21 to have a uniform electric potential. A charge bias voltage is applied to the charging roller 23. Instead of the charging roller 23, a corona charger (not shown) may be used. A developing roller 22 supplies toner to an electrostatic latent image formed on a surface of the photosensitive drum 21 to develop the electrostatic latent image.

In a two-component developing method in which toner and a carrier are used as a developer, the developing roller 22 may be in the form of a sleeve inside of which a magnet is fixed. The sleeve may be located apart from the photosensitive drum 21 by tens to hundreds of micrometers. The carrier is attached to an outer circumference of the developing roller 22 via a magnetic force of a magnet, and the toner is attached to the carrier via an electrostatic force, thereby forming a magnetic brush including the carrier and the toner on the outer circumference of the developing roller 22. According to a developing bias applied to the developing roller 22, only the toner is moved to the electrostatic latent image formed on the photosensitive drum 21.

In a one-component developing method in which toner is used as a developer, the developing roller 22 may be in contact with the photosensitive drum 21, and may be located apart from the photosensitive drum 21 by tens to hundreds of micrometers. In the example, a one-component contact developing method in which the developing roller 22 and the photosensitive drum 21 contact each other to form a developing nip is used. The developing roller 22 may be in the form of an elastic layer (not shown) formed on an outer circumference of a conductive metal core (not shown). When a developing bias voltage is applied to the developing roller 22, the toner is moved via the developing nip, to the electrostatic latent image formed on a surface of the photosensitive drum 21 to be attached to the electrostatic latent image.

A supplying roller 24 attaches the toner to the developing roller 22. A supply bias voltage may be applied to the supplying roller 24 to attach the toner to the developing roller 22. Reference numeral 25 denotes a regulating member regulating a toner amount attached to the surface of the developing roller 22. The regulating member 25 may be, for example, a regulating blade having a front end that contacts the developing roller 22 at a certain pressure. Reference numeral 26 denotes a cleaning member used to remove residual toner and foreign substances from the surface of the photosensitive drum 21 before charging. The cleaning member 26 may be, for example, a cleaning blade having a front end that contacts the surface of the photosensitive drum 21 at a certain pressure. Hereinafter, foreign substances removed from the surface of the photosensitive drum 21 will be referred to as waste toner.

An optical scanner 4 scans light modulated according to image information, onto a surface of the photosensitive drum 21 charged to a uniform electric potential. As the optical scanner 4, for example, a laser scanning unit (LSU) that scans light radiated from a laser diode onto the photosensitive drum 21 by deflecting the light by using a polygon mirror, in a main scanning direction, may be used.

A transfer roller 5 is an example of a transfer unit that is located to face the photosensitive drum 21 to form a transfer nip. A transfer bias voltage used to transfer a toner image developed on the surface of the photosensitive drum 21 to a print medium P is applied to the transfer roller 5. Instead of the transfer roller 5, a corona transfer unit may be used.

The toner image transferred to a surface of the print medium P via the transfer roller 5 is maintained on the surface of the print medium P due to an electrostatic attractive force. A fusing or fixing unit 6 fuses the toner image on the print medium P by applying heat and pressure to the toner image, thereby forming a permanent print image on the print medium P.

Referring to FIGS. 2 and 3, the development cartridge 2 according to the example includes a developing portion 210 in which the photosensitive drum 21 and the developing roller 22 are mounted, a waste toner container 220 receiving waste toner removed from the photosensitive drum 21, and a toner container 230 connected to the developing portion 210 and containing toner. In order to refill toner in the toner container 230, the development cartridge 2 includes a toner refilling portion 10 connected to the toner container 230. The toner refilling portion 10 provides an interface with respect to the toner refill cartridge 9 which will be described later and the development cartridge 2. The development cartridge 2 is an integrated type development cartridge including the developing portion 210, the waste toner container 220, the toner container 230, and the toner refilling portion 10.

A portion of an outer circumference of the photosensitive drum 21 is exposed outside a housing. A transfer nip is formed as the transfer roller 5 contacts an exposed portion of the photosensitive drum 21. At least one conveying member conveying toner towards the developing roller 22 may be installed in the developing portion 210. The conveying member may also perform a function of charging toner to a certain electric potential by agitating the toner.

The waste toner container 220 is located above the developing portion 210. The waste toner container 220 is spaced apart from the developing portion 210 in an upward direction to form a light path 250 therebetween. Waste toner removed from the photosensitive drum 21 by using the cleaning member 26 is received in the waste toner container 220. The waste toner removed from the surface of the photosensitive drum 21 is fed into the waste toner container 220 via a waste toner feeding member 221, 222, and 223. The shape and number of waste toner feeding members are not limited. An appropriate number of waste toner feeding members may be installed at appropriate locations to distribute waste toner effectively in the waste toner container 220 by considering a volume or shape of the waste toner container 220.

The toner container 230 is connected to the toner refilling portion 10 to receive toner. The toner container 230 is connected to the developing portion 210 via a toner supplier 234 as denoted by a dotted line illustrated in FIG. 2. As illustrated in FIG. 2, the toner supplier 234 may pass through the waste toner container 220 vertically to be connected to the developing portion 210. The toner supplier 234 is located outside an effective width of exposed light L such that the toner supplier 234 does not interfere with the exposed light L scanned in a main scanning direction by using the optical scanner 4.

Toner supplying members 231, 232, and 233 used to supply toner to the developing portion 210 through the toner supplier 234 may be installed in the toner container 230. The shape and number of toner supplying members are not limited. An appropriate number of toner supplying members may be installed at appropriate locations to supply toner effectively to the developing portion 210 by considering a volume or shape of the toner container 230. The toner supplying member 233 may convey toner in a main scanning direction to transfer the same to the toner supplier 234.

An image forming process according to the above-described configuration will be described briefly. A charge bias is applied to the charging roller 23, and the photosensitive drum 21 is charged to a uniform electric potential. The optical scanner 4 scans light modulated in accordance with image information, onto the photosensitive drum 21, thereby forming an electrostatic latent image on a surface of the photosensitive drum 21. The supplying roller 24 attaches the toner to a surface of the developing roller 22. The regulating member 25 forms a toner layer having a uniform thickness on the surface of the developing roller 22. A developing bias voltage is applied to the developing roller 22. As the developing roller 22 is rotated, toner conveyed to a developing nip is moved and attached to the electrostatic latent image formed on the surface of the photosensitive drum 21 via the developing bias voltage, thereby forming a visible toner image on the surface of the photosensitive drum 21. The print medium P withdrawn from a loading tray 7 via a pickup roller 71 is fed, via a feeding roller 72, to the transfer nip where the transfer roller 5 and the photosensitive drum 21 face each other. When a transfer bias voltage is applied to the transfer roller 5, the toner image is transferred to the print medium P via an electrostatic attractive force. As the toner image transferred to the print medium P receives heat and pressure from the fusing unit 6, the toner image is fused to the print medium P, thereby completing printing. The print medium P is discharged by using a discharge roller 73. The toner that is not transferred to the print medium P but remains on the surface of the photosensitive drum 21 is removed by using the cleaning member 26.

As described above, the development cartridge 2 supplies the toner contained in the toner container 230 to the electrostatic latent image formed on the photosensitive drum 21 to form a visible toner image, and is attachable to/detachable from the main body 1. In addition, the development cartridge 2 includes the toner refilling portion 10 used to refill toner. The toner refilling portion 10 may be integrated with the development cartridge 2 and thus may be attachable to/detachable from the main body 1 together with the development cartridge 2. According to the image forming apparatus of the example, without removing the development cartridge 2 from the main body 1, toner may be refilled in the development cartridge 2 while the development cartridge 2 is mounted in the main body 1.

Figure 4:
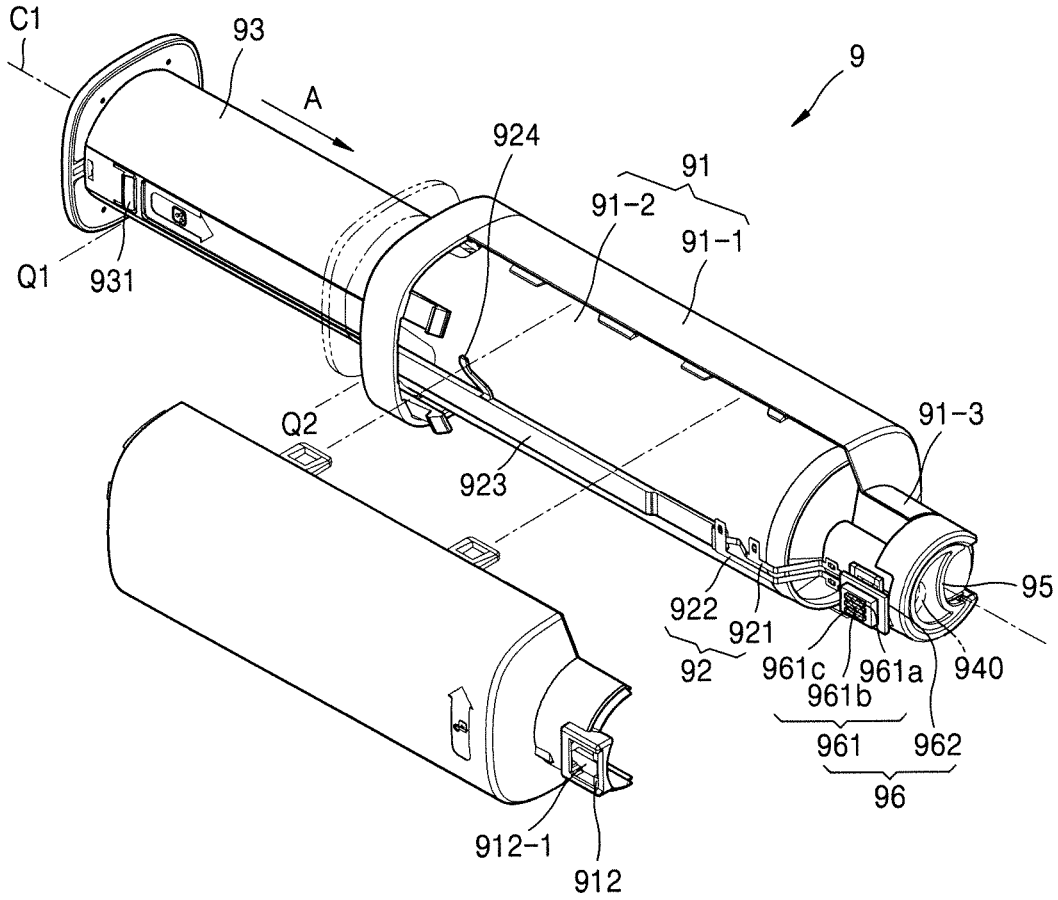
FIG. 4 is a partially exploded perspective view of a toner refill cartridge, according to an example.
Figure 5A:
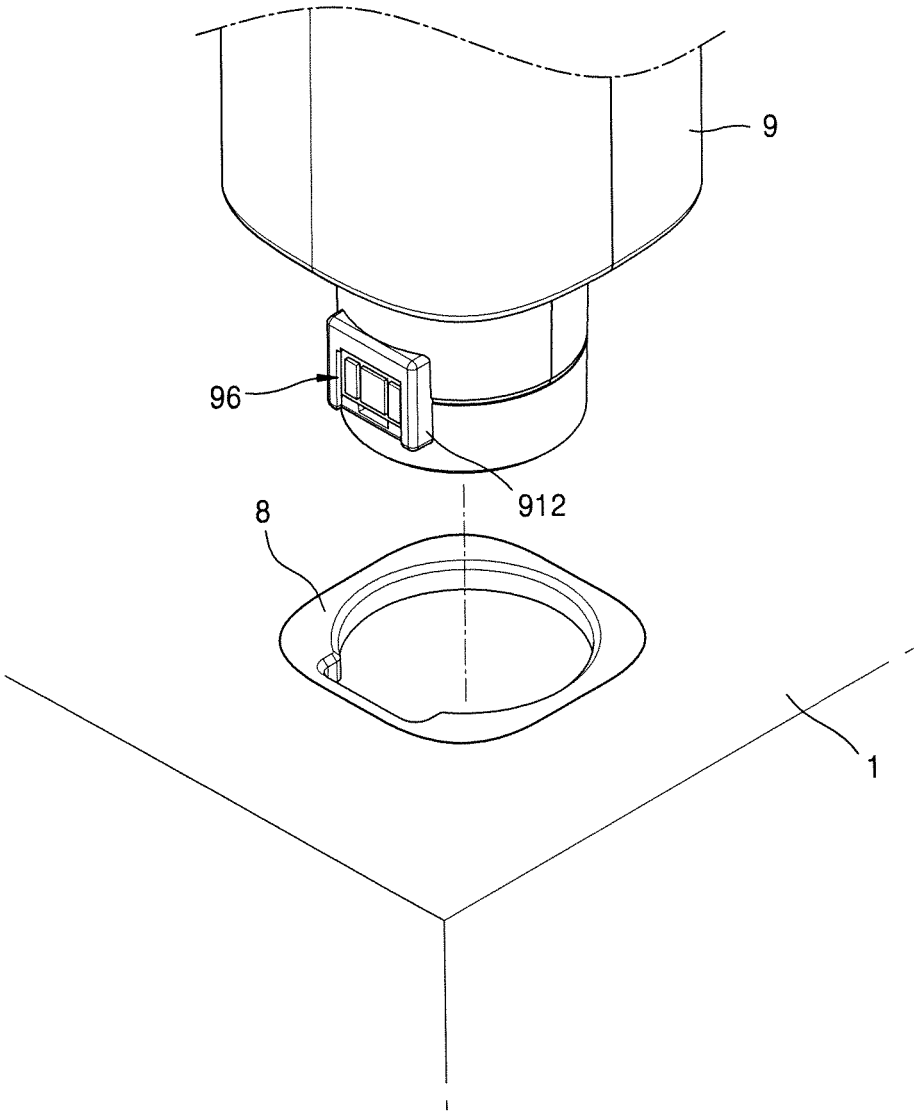
FIGS. 5A and 5B are views of a toner refill cartridge accessing a toner refilling portion from outside a main body of an image forming apparatus through a communicating portion, according to an example.
Figure 5B:
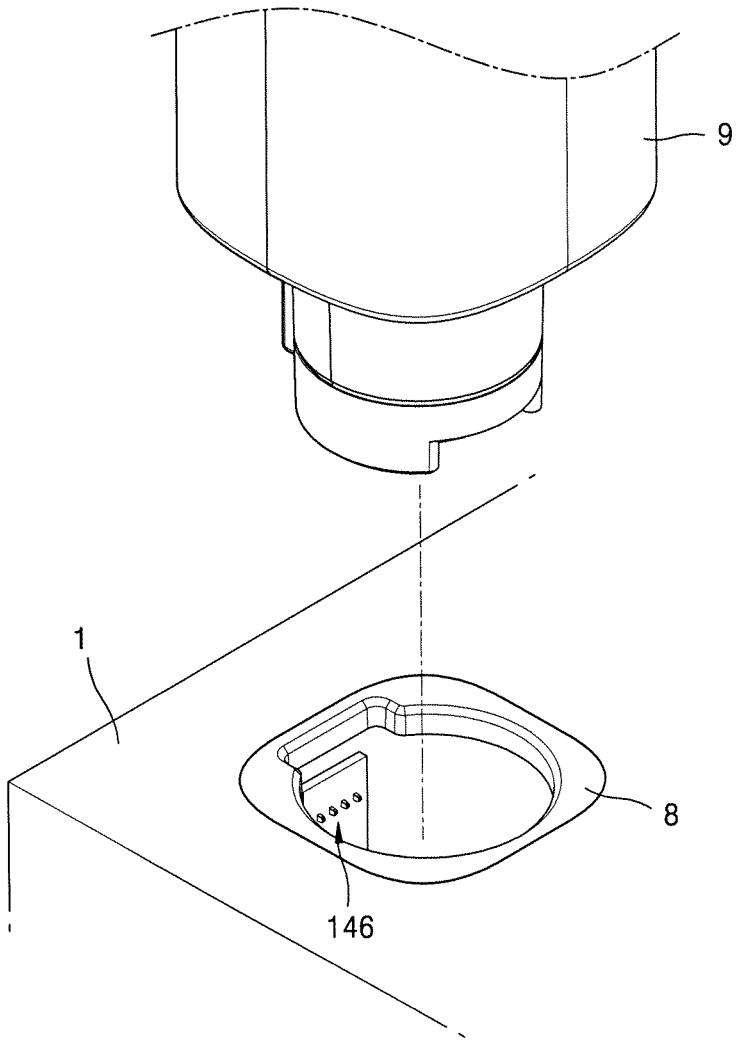
Figure 6:
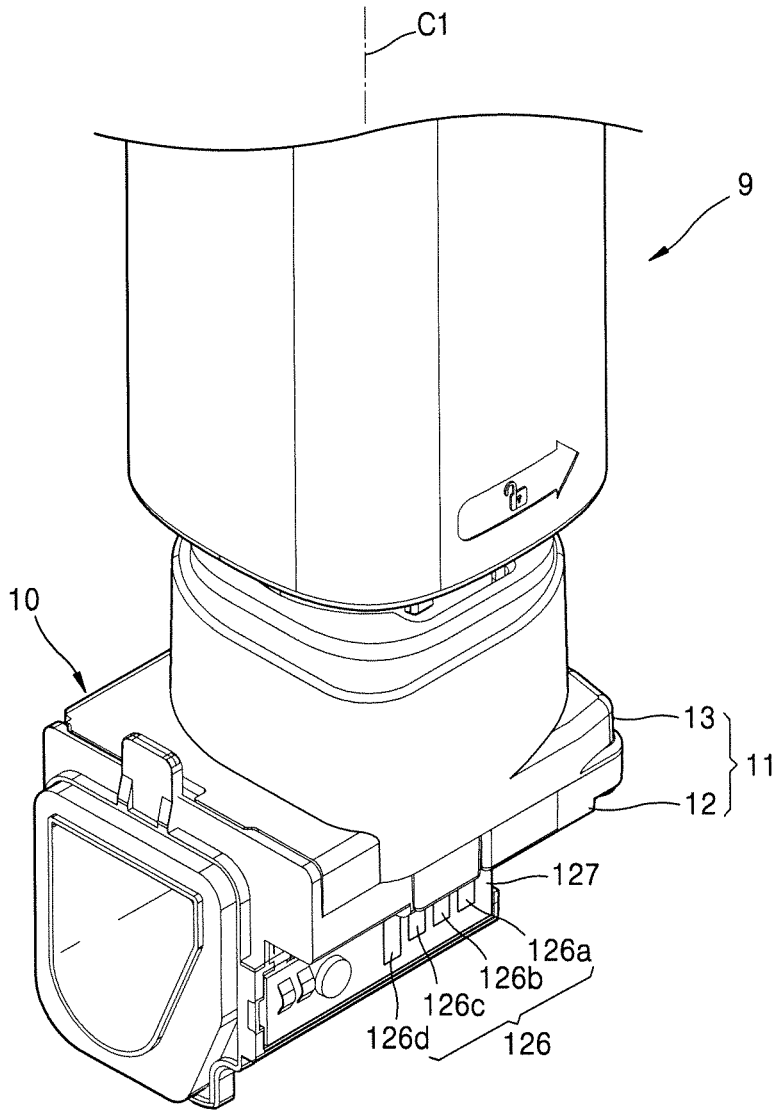
FIG. 6 is a perspective view of a toner refilling portion equipped with a toner refill cartridge, according to an example.
Figure 7:
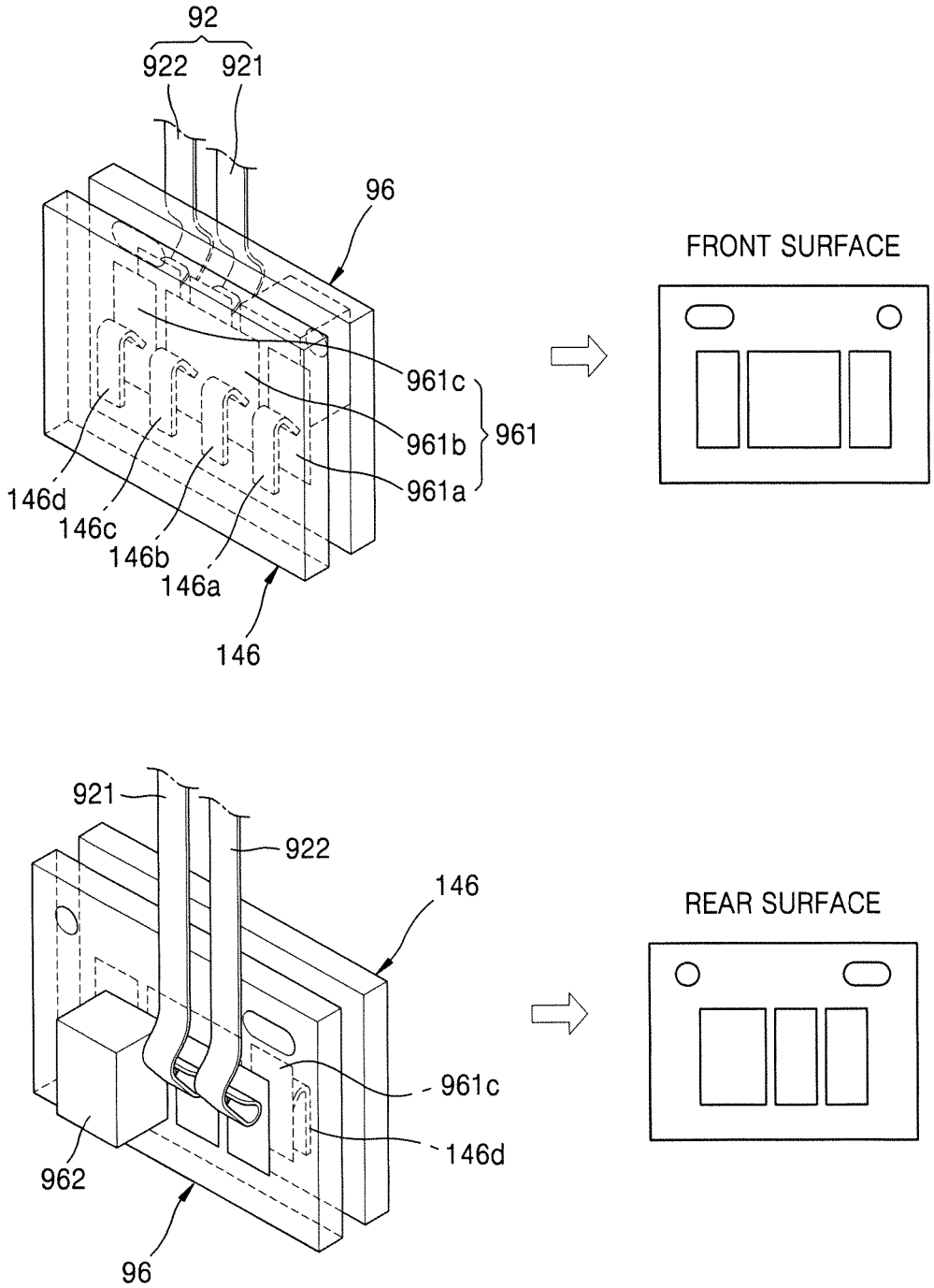
FIG. 7 is a view for explaining an electrical connection between a connection interface of a toner refill cartridge and a first connector of a toner refilling portion, according to an example.

FIG. 4 is a perspective view of an example of the toner refill cartridge 9. FIGS. 5A and 5B are views of the toner refill cartridge 9 accessing the toner refilling portion 10 from outside the main body 1 of the image forming apparatus through the communicating portion 8. FIG. 6 is a perspective view of an example of the toner refilling portion 10 equipped with the toner refill cartridge 9. FIG. 7 is a view for explaining an electrical connection between a connection interface 96 of the toner refill cartridge 9 and a first connector 146 of the toner refilling portion 10.

Referring to FIGS. 4 to 7, the toner refill cartridge 9 may be a syringe toner refill cartridge including a body 91 accommodating toner and having a toner discharge portion 940, and a plunger 93 which is movably coupled to the body 91 in a longitudinal direction A to push toner out of the body 91. The toner discharge portion 940 may be provided at a tip portion 91-3 of the body 91. A discharge shutter 95 may selectively open and close the toner discharge portion 940. A protruding portion 912 partially protruding outwardly may be provided at the tip portion 91-3 of the body 91.

The body 91 may include an outer body 91-1 and an inner body 91-2 located inside the outer body 91-1 and accommodating toner. The toner discharge portion 940 is provided in the inner body 91-2. The plunger 93 may be inserted into the inner body 91-2 and moved in the longitudinal direction A. The plunger 93 may be moved from an upper position Q1 to a lower position Q2. The discharge shutter 95 may be provided so as to be independently rotatable with respect to the tip portion 91-3 of the body 91. For example, as shown in FIG. 4, the discharge shutter 95 may be located in a closed position that blocks the toner discharge portion 940. Further, the discharge shutter 95 may be located at a discharge position where the discharge shutter 95 is rotated 180 degrees with respect to the body 91 to open the toner discharge portion 940. The discharge shutter 95 may be rotated with respect to a first rotation axis C1. The first rotation axis C1 may be, for example, a central axis of the cylindrical tip portion 91-3.

The toner refill cartridge 9 may include a toner injection completion signal generator 92 used for detecting completion of injection of toner. For example, referring to the example of FIG. 4, the toner injection completion signal generator 92 may include a pair of electrodes 921 and 922 provided between the outer body 91-1 and the inner body 91-2. The pair of electrodes 921 and 922 may be respectively connected to electrical contacts 961*b* and 961*c*. An electrical contact state of the pair of electrodes 921 and 922 may vary depending on a position of the plunger 93. The electrical contact state of the pair of electrodes 921 and 922 may change from a first state to a second state when the plunger 93 enters the lower position Q2. For example, the first state and the second state may be an electrical open state and an electrical short state, respectively, or vice versa. An operating lever 923 movable in the longitudinal direction A may be provided between the outer body 91-1 and the inner body 91-2 in order to change the electrical contact state of the pair of electrodes 921 and 922. The plunger 93 may include a pushing protrusion 931 which pushes the operating lever 923 when the plunger 93 enters the lower position Q2 to bring the pair of electrodes 921 and 922 into contact with or spaced from each other. A hooking member 924 provided on the operating lever 923 may be locked and fixed to a protruding portion formed on the body 91 until the plunger 93 reaches a certain position.

A connection interface 96 may be provided at the tip portion 91-3 of the body 91. When the toner refill cartridge 9 is mounted on the toner refilling portion 10, the connection interface 96 may be electrically connected to the main body 1 to transfer information of the toner refill cartridge 9 to the main body 1. In the example, the connection interface 96 may be electrically connected to the main body 1 via the first connector 146 provided in the toner refilling portion 10. The main body 1, for example, a controller provided in the main body 1, may determine whether or not the toner refill cartridge 9 is mounted depending on whether the controller is electrically connected to the connection interface 96, for example, whether the controller can communicate with the connection interface 96.

The connection interface 96 may include a circuit unit 962 for managing information of the toner refill cartridge 9 and an electrical contact portion 961 for connection with the main body 1. The circuit unit 962 may be a customer replaceable unit monitor (CRUM) including a processor for performing at least one of authentication and/or encrypted data communication with the main body 1. The circuit unit 962 may further include a memory. The memory may store various types of information for the toner refill cartridge 9. For example, information about a manufacturer, information about manufacturing date and time, unique information such as serial number, model name, and the like, various programs, digital signature information, and a usage state (e.g., how many sheets have been printed so far, how many remaining sheets can be printed, and how much toner is remaining) may be stored in the memory. In addition, information about a lifetime of the toner refill cartridge 9, setup menu, and the like may be stored in the memory. In addition, the circuit unit 962 may include functional blocks capable of performing various functions for communication authentication, encryption, and the like with the main body 1. The circuit unit 962 may be implemented in the form of a chip including a processor and/or a memory, or a printed circuit board assembly (PBA) in which circuit elements for implementing chips and various functional blocks are mounted.

The electrical contact portion 961 may have various forms such as a conductive pattern, a modular jack, a resilient terminal, and the like, which may be electrically connected to the main body 1. The electrical contact portion 961 of the example shown in FIG. 4 is a conductive pattern. The electrical contact portion 961 may be exposed to outside the body 91 through an opening 912-1 provided in the protruding portion 912.

For example, the electrical contact portion 961 may have three electrical contacts 961*a*, 961*b*, and 961*c*. The first electrical contact 961*a* may be for transmitting information stored in the memory of the circuit unit 962 to the main body 1 of the image forming apparatus. The second electrical contact 961*b* may be for transmitting a signal regarding whether or not the toner refill cartridge 9 is mounted on the toner refilling portion 10 to the main body 1 of the image forming apparatus. The third electrical contact 961*c* may be for transmitting a toner injection completion signal or a removal request signal of the toner refill cartridge 9 to the main body 1 of the image forming apparatus.

As shown in FIGS. 5A and 5B, the toner refill cartridge 9 may be mounted on the toner refilling portion 10 through the communicating portion 8 from the outer surface of the main body 1 of the image forming apparatus. FIG. 5A is a front view of the toner refill cartridge 9 when the toner refill cartridge 9 accesses the communicating portion 8. FIG. 5B is a rear view of the toner refill cartridge 9 when the toner refill cartridge 9 accesses the communicating portion 8. When the toner refill cartridge 9 is inserted into the communicating portion 8 from above the main body 1, the toner refill cartridge 9 may be mounted on the toner refilling portion 10 as shown in FIG. 6. When the plunger 93 of the toner refill cartridge 9 is pushed in the longitudinal direction A of the body 91 in a state in which the toner refill cartridge 9 is mounted on the toner refilling portion 10, toner accommodated in the body 91 may be discharged through the toner discharge portion 940 and supplied to the toner container portion 230 of the development cartridge 2 through the toner refilling portion 10. The toner refill cartridge 9 may be removed from the communicating portion 8 after completion of the toner injection.

According to this configuration, as toner is refilled in the toner container 230 by using the toner refilling portion 10, a replacement time of the development cartridge 2 may be extended until the lifetime of the photosensitive drum 21 ends, thereby reducing printing costs per sheet. In addition, toner may be refilled while the development cartridge 2 is mounted in the main body 1, and thus, user convenience may be increased.

When the toner refill cartridge 9 is mounted on the toner refilling portion 10 of the image forming apparatus, the connection interface 96 of the toner refill cartridge 9 may be electrically connected to the first connector 146 located at a certain portion of the toner refilling portion 10. The connection interface 96 of the toner refill cartridge 9 may be electrically connected to the main body 1, for example, a controller 300 provided in the main body 1 through the first connector 146 and a second connector 127 provided in the toner refilling portion 10. When the toner refill cartridge 9 is mounted on a mounting portion 11 through the insertion portion of an upper body 13, the first connector 146 may be directly connected to the electrical contact portion 961 of the connection interface 96. The first connector 146 may be connected to the second connector 127 by a flexible cable and the second connector 127 may be electrically connected to a controller 300 provided on the main body 1.

Referring to FIGS. 6 and 7, the electrical contact portion 961 including the three electrical contacts 961*a*, 961*b*, and 961*c* may be provided on a front surface of the connection interface 96 and the circuit unit 962 including a memory for storing information about the toner refill cartridge 9 may be implemented on a rear surface of the connection interface 96. The first connector 146 may include four electrical contacts 146*a*, 146*b*, 146*c*, and 146*d*. However, the disclosure is not so limited and there may be more or less than four electrical contacts. The four electrical contacts 146*a*, 146*b*, 146*c*, and 146*d* of the first connector 146 may correspond to the three electrical contacts 961*a*, 961*b*, and 961*c* of the connection interface 96. For example, the first electrical contact 961*a* of the connection interface 96 may be electrically connected to the first electrical contact 146*a* of the first connector 146. The electrical contact 961*b* of the connection interface 96 may be electrically connected to the second electrical contact 146*b* and/or the third electrical contact 146*c* of the first connector 146. The third electrical contact 961*c* of the connection interface 96 may be electrically connected to the fourth electrical contact 146*d* of the first connector 146. The four electrical contacts 146*a*, 146*b*, 146*c*, and 146*d* may be electrically connected to the mounting portion 11, for example, the second connector 127 provided on a lower body 12 of the toner refilling portion 10, by a flexible cable. Thus, a stable electrical connection between the first connector 146 and the second connector 127 may be maintained. The second connector 127 may include an electrical contact portion 126, and the electrical contact portion 126 may include four electrical contacts 126*a*, 126*b*, 126*c*, and 126*d*. The four electrical contacts 146*a*, 146*b*, 146*c*, and 146*d* of the first connector 146 may be electrically connected to the four electrical contacts 126*a*, 126*b*, 126*c*, and 126*d* of the second connector 127 by a flexible cable, respectively. As a result, when the toner refill cartridge 9 is mounted on the mounting portion 11, the second connector 127 may be electrically connected to the connection interface 96 of the toner refill cartridge 9 through the first connector 146 of the toner refilling portion 10.

Figure 8:
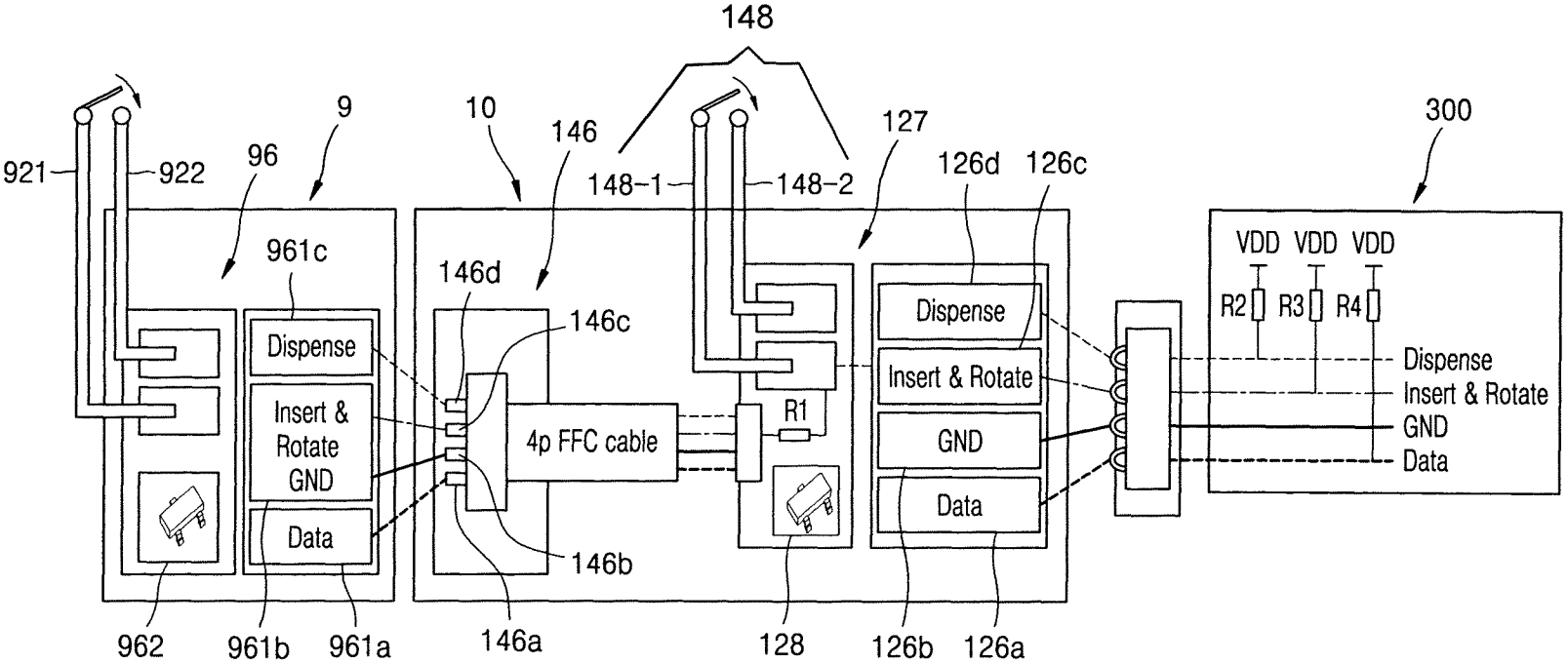
FIG. 8 is a view for explaining a connection structure between a toner refill cartridge, a toner refilling portion in a development cartridge, and a controller, according to an example.
Figure 9:
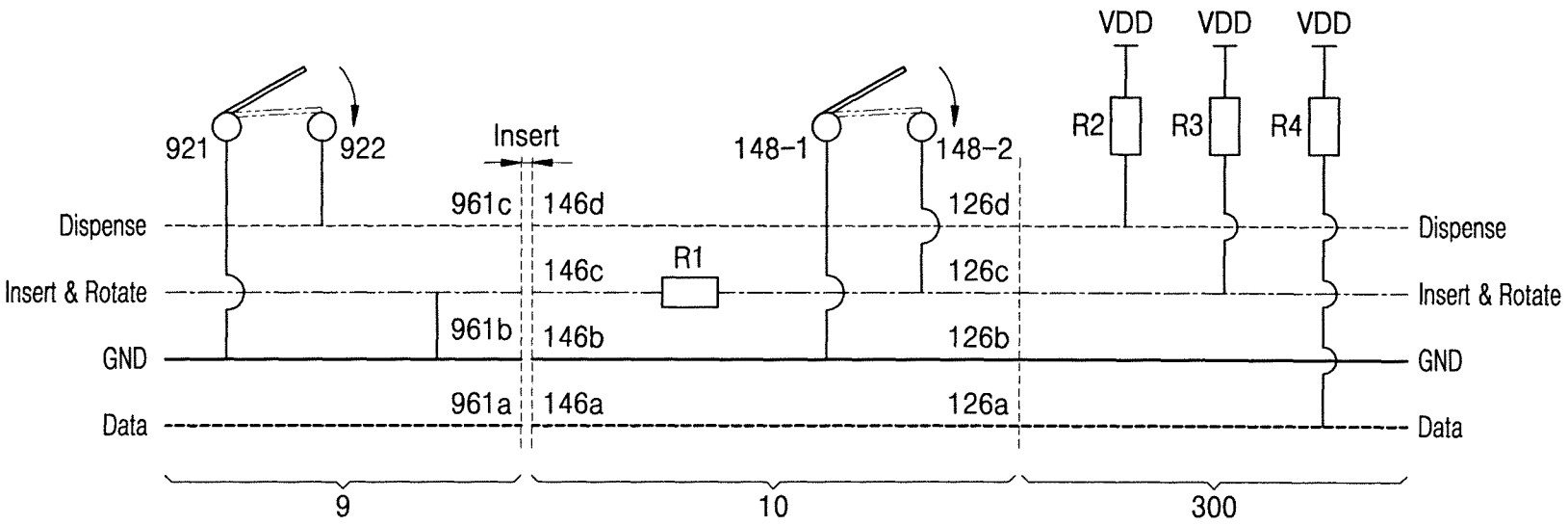
FIG. 9 is a view for explaining information transmission between a toner refill cartridge, a toner refilling portion, and a controller when the toner refill cartridge is mounted on the toner refilling portion in a development cartridge, according to an example.

FIG. 8 is a view for explaining a connection structure between the toner refill cartridge 9, the toner refilling portion 10 in the development cartridge 2, and a controller 300. FIG. 9 is a view for explaining information transmission between the toner refill cartridge 9, the toner refilling portion 10, and the controller 300 when the toner refill cartridge 9 is mounted on the toner refilling portion 10 in the development cartridge 2.

Referring to FIGS. 8 and 9, the connection structure and operation between an image forming apparatus and the toner refill cartridge 9 connected to the main body 1 of the image forming apparatus through an interface between the development cartridge 2 and the main body 1 can be seen. The development cartridge 2 and the toner refill cartridge 9 are consumables removable from the image forming apparatus, and the toner refilling portion 10 in the development cartridge 2 may utilize the same interface as that of the development cartridge 2 to connect the development cartridge 2 and the toner refill cartridge 9 to the main body 1 of the image forming apparatus.

The image forming apparatus may include the main body 1, the development cartridge 2 removable from the main body 1, the toner refilling portion 10 in the development cartridge 2, and the controller 300. The development cartridge 2 supplies toner accommodated in the toner container portion 230 to an electrostatic latent image formed on a photoconductor to form a toner image, the development cartridge 2 being removable from the main body 1. The toner refilling portion 10 may be in the development cartridge 2, and the toner refill cartridge 9 for refilling toner in the toner container portion 230 may be mounted on the toner refilling portion 10. The controller 300 may control operations of the image forming apparatus based on a connection between the development cartridge 2 mounted on the main body 1 and the toner refill cartridge 9 mounted on the toner refilling portion 10. The toner refilling portion 10 may connect the toner refill cartridge 9 mounted on the toner refilling portion 10 to the main body 1 through the interface between the development cartridge 2 and the main body 1. The toner refilling portion 10 may be formed integrally with the development cartridge 2.

The toner refilling portion 10 may include the first connector 146 electrically connected to the toner refill cartridge 9 mounted on the toner refilling portion 10 and the second connector 127 electrically connected to the controller 300 provided in the main body 1. The second connector 127 includes a circuit unit 128 for managing information about the development cartridge 2 and may transmit information about the toner refill cartridge 9 obtained through the first connector 146 and information about the development cartridge 2 obtained from the circuit unit 128 to the controller 300.

As shown in FIG. 8, the first connector 146 and the second connector 127 may be connected to each other by a flexible flat cable. The first connector 146 and the second connector 127 connected by the flexible flat cable may be provided as an integrated assembly in the toner refilling portion in the toner refilling portion 10. The circuit unit 128 may be arranged on a surface opposite to a contact surface of the second connector 127 on which the electrical contact portion 126 electrically connected to the main body 1 is provided. The four electrical contacts 146*a*, 146*b*, 146*c*, and 146*d* provided in the first connector 146 may be connected to the four electrical contacts 126*a*, 126*b*, 126*c*, and 126*d* provided in the second connector 127, respectively.

The toner refilling portion 10 may be electrically connected to the toner refill cartridge 9 mounted on the toner refilling portion 10 and the main body 1 and may transmit the information about the toner refill cartridge 9 and the information about the development cartridge 2 to the controller 300 through the interface between the development cartridge 2 and the main body 1. The information about the toner refill cartridge 9 may include information for authentication of the toner refill cartridge 9 and the information about the development cartridge 2 may include information for authentication of the development cartridge 2.

The controller 300 may be connected to the toner refill cartridge 9 through the second connector 127 provided in the toner refilling portion 10 and the first connector 146. The controller 300 may control operations of the image forming apparatus based on signals or information received through the plurality of electrical contacts 126*a*, 126*b*, 126*c*, and 126*d* provided in the second connector 127.

Referring to FIGS. 8 and 9, the image forming apparatus may have an electrical structure for detecting whether the toner refill cartridge 9 is mounted on the toner refilling portion 10. For example, the first connector 146 of the toner refilling portion 10 may include the electrical contact 146*c* electrically connected to the electrical contact 961*b* provided in the connection interface 96 of the toner refill cartridge 9 when the toner refill cartridge 9 is mounted on the mounting portion 11 of the toner refilling portion 10, and the electrical contact 146*c* of the first connector 146 may be connected to the controller 300 through the electrical contact 126*c* of the second connector 127. The controller 300 may detect whether the electrical contact 961*b* of the connection interface 96 is electrically connected to the electrical contact 146*c* of the first connector 146 and the electrical contact 126*c* of the second connector 127, thereby detecting whether or not the toner refill cartridge 9 has been mounted on the toner refilling portion 10. For example, when the toner refill cartridge 9 is mounted on the toner refilling portion 10, the electrical contact 961*b* of the connection interface 96 may be electrically connected to the electrical contact 126*c* of the second connector 127 through the electrical contact 146*c* of the first connector 146.

Whether or not the toner refill cartridge 9 is mounted on the toner refilling portion 10, that is, whether or not the connection interface 96 is connected to the first connector 146 may be determined by a circuit including a reference voltage VDD and two resistors R1 and R3. For example, when the toner refill cartridge 9 is not mounted on the toner refilling portion 10, no current flows through a circuit passing through the electrical contact 126*c* of the second connector 127, so that the reference voltage VDD, for example, 3.3 V, is applied to a first input port of the controller 300 connected to the electrical contact 126*c* of the second connector 127. Meanwhile, when the toner refill cartridge 9 is mounted on the toner refilling portion 10, the circuit passing through the electrical contact 126*c* of the second connector 127 may be a circuit in which the resistor R1 and the resistor R3 are connected in parallel to each other. When resistance values of the resistors R1 and R3 are identical, for example, a voltage of 1.65 V may be applied to the first input port of the controller 300. In other words, the controller 300 may detect whether or not the toner refill cartridge 9 is mounted on the toner refilling portion 10 based on a change in a voltage flowing through the second connector 127 depending on whether the toner refill cartridge 9 is mounted on the toner refilling portion 10 with respect to the reference voltage VDD applied to the controller 300, and may control the image forming apparatus according to a result of the detection.

Figure 10:
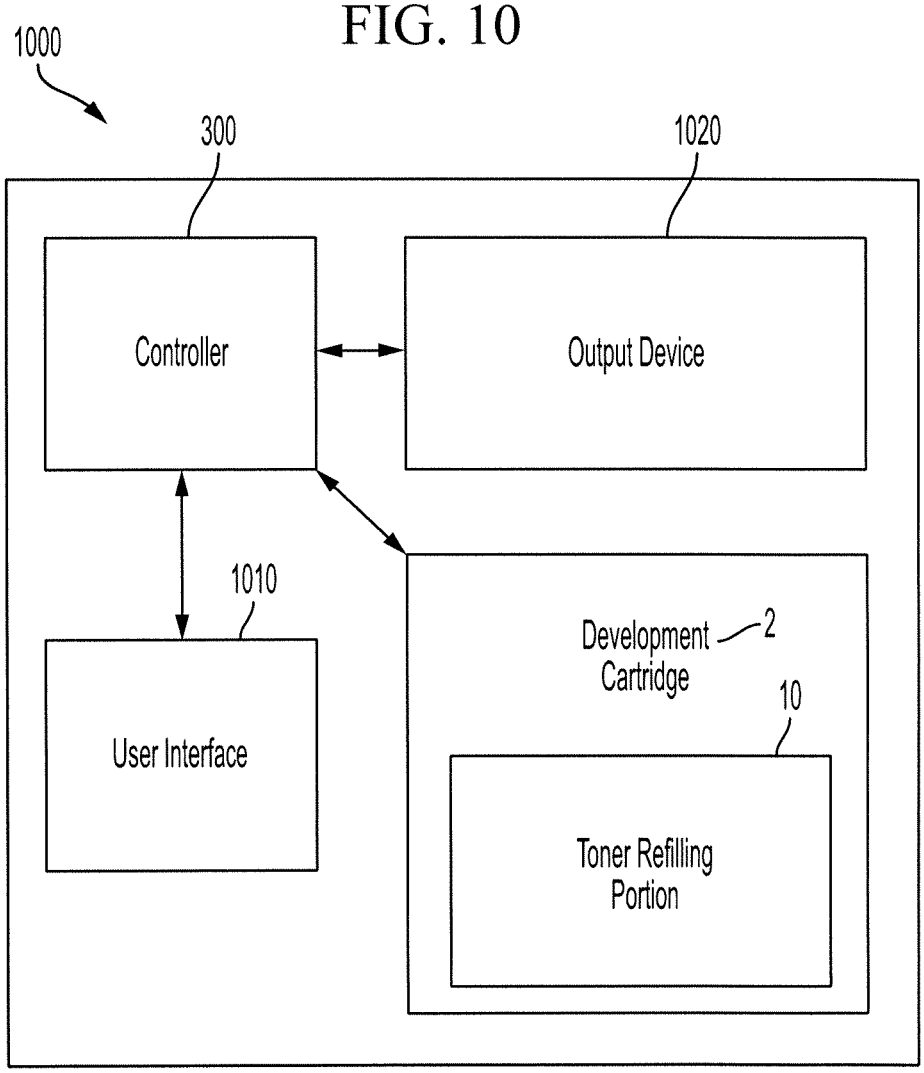
FIG. 10 is a block diagram of an image forming apparatus, according to an example.

FIG. 10 is a block diagram of an image forming apparatus 1000, according to an example. The image forming apparatus 1000 may include some or all of the features shown in the image forming apparatus illustrated in FIG. 2. With reference to FIG. 10, the image forming apparatus 1000 may also include a user interface 1010 which provides a user with information regarding whether the toner refill cartridge 9 is mounted on the toner refilling portion 10. The user interface 1010 may include, for example, a keyboard (e.g., a physical keyboard, virtual keyboard, etc.), a button, a switch, a gesture recognition sensor (e.g., to recognize gestures of a user including movements of a body part), an input sound device or voice recognition sensor (e.g., a microphone to receive a voice command), a track ball, and the like. The user interface 1010 may further include a haptic device to provide haptic feedback to a user. The user interface 1010 may also include a touchscreen, for example. The information regarding whether the toner refill cartridge 9 is mounted on the toner refilling portion 10 may be output in the form of a message presented on a screen of the user interface 1010, by providing a light indication, such as a green light indicating successful mounting of the toner refill cartridge 9 or a red light indicating an unsuccessful mounting of the toner refill cartridge 9. Further the output may be in the form of haptic feedback presented through the user interface 1010. The image forming apparatus 1000 may also include an output device 1020 such as a speaker, which may also provide a user information regarding whether the toner refill cartridge 9 is mounted on the toner refilling portion 10. The speaker may indicate a successful or unsuccessful mounting of the toner refill cartridge 9 by playing a message or by outputting a sound indicating the mounting status of the toner refill cartridge 9 on the toner refilling portion 10. By providing such information to a user, the user can know whether the toner refill cartridge 9 is successfully or unsuccessfully mounted to the toner refilling portion 10. When the user knows the toner refill cartridge 9 is successfully mounted to the toner refilling portion 10, the user can perform a plunging operation to successfully discharge the toner from the toner refill cartridge 9. When the user is made aware that the toner refill cartridge 9 is unsuccessfully mounted to the toner refilling portion 10, the user can avoid an erroneous operation such as attempting to perform a plunging operation which cannot successfully be performed due to the toner discharging portion 940 not being aligned with a toner inlet portion 120 of the toner refilling portion 10.

When the toner refill cartridge 9 is mounted on the toner refilling portion 10, the circuit unit 962 provided in the connection interface 96 of the toner refill cartridge 9 may be connected to a data input port of the controller 300 through the electrical contact 961*a* of the connection interface 96, the electrical contact 146*a* of the first connector 146, and the electrical contact 126*a* of the second connector 127. The controller 300 may read information about the toner refill cartridge 9 from the circuit unit 962 provided in the connection interface 96 of the toner refill cartridge 9. The information about the toner refill cartridge 9 may include information for authentication of the toner refill cartridge 9. Meanwhile, when the development cartridge 2 is mounted on the main body 1 of the image forming apparatus, the circuit unit 128 provided in the second connector 127 of the toner refilling portion 10 may be connected to the data input port of the controller 300 through the electrical contact 126*a* of the second connector 127. The controller 300 may read information about the development cartridge 2 from the circuit unit 128 provided in the second connector 127 of the toner refilling portion 10. The information about the development cartridge 2 may include information for authentication of the development cartridge 2. Therefore, the controller 300 may receive the information about the toner refill cartridge 9 and the information about the development cartridge 2 through the interface between the development cartridge 2 and the main body 1.

Meanwhile, the toner refilling portion 10 may include a rotation detection sensor 148 for detecting that the toner refill cartridge 9 mounted on the toner refilling portion 10 enters a certain position depending on the rotation of the toner refill cartridge 9. The rotation detecting sensor 148 may include a pair of electrodes 148-1 and 148-2 whose electrical connection state changes depending on a result of the rotation detection of the toner refill cartridge 9. The toner refilling portion 10 may transmit whether or not the mounted toner refill cartridge 9 has reached a certain position by rotation to the controller 300 through the second connector 127, based on a result of the detection of the toner refill cartridge 9. For example, the toner refilling portion 10 may transmit a signal indicating that the toner refill cartridge 9 is successfully mounted to the toner refilling portion 10 and that the toner refilling portion 10 is ready to receive toner from the toner refill cartridge 9 when the toner refill cartridge 9 is rotated by a predetermined amount, for example, 180 degrees or 90 degrees. For example, the toner refilling portion 10 may transmit another signal indicating that the toner refill cartridge 9 is not successfully mounted to the toner refilling portion 10 when the toner refill cartridge 9 has not been rotated by the predetermined amount, for example, 180 degrees or 90 degrees. However, the degree of rotation corresponding to the predetermined amount is not limited to 180 degrees or 90 degrees and may be different than 180 degrees or 90 degrees.

For example, the rotation detection sensor 148 may change an electrical contact state of the pair of electrodes 148-1 and 148-2 when an inlet shutter 14 (see FIG. 11) provided in the mounting portion 11 of the toner refilling portion 10 enters a certain position as the inlet shutter rotates in conjunction with the rotation of the toner refill cartridge 9. One of the pair of electrodes 148-1 and 148-2 may be a fixed electrode and the other electrode may be an elastic electrode that can be elastically contacted/separated to/from the fixed electrode. The pair of electrodes 148-1 and 148-2 may be connected to the controller 300 through the electrical contact 126*c* provided in the second connector 127. The electrical contact state of the pair of electrodes 148-1 and 148-2 may change from a first state to a second state when the inlet shutter 14 rotating in conjunction with the rotation of the toner refill cartridge 9 mounted on the toner refilling portion 10 enters a certain position, for example the inlet position which to be further described later. The first state and the second state may be an electrical open state and an electrical short state, respectively, or vice versa. For example, the toner refilling portion 10 may transmit a signal indicating that the toner refill cartridge 9 is successfully mounted to the toner refilling portion 10 and ready to receiver toner from the toner refill cartridge 9 when the inlet shutter 14 is rotated by a predetermined amount, for example, 180 degrees or 90 degrees, to the inlet position. For example, the toner refilling portion 10 may transmit another signal indicating that the toner refill cartridge 9 is not successfully mounted to the toner refilling portion 10 when the inlet shutter 14 has not been rotated by the predetermined amount. However, the degree of rotation is not limited to 180 degrees or 90 degrees and may be different than 180 degrees or 90 degrees.

As described above, when a reference voltage applied to the controller 300 is 3.3 V and resistance values of the resistors R1 and R3 are identical and when the toner refill cartridge 9 is mounted on the toner refilling portion 10, a voltage of 1.65 V may be applied to the controller 300 by the voltage flowing through the second connector 127. Here, when the toner refill cartridge 9 mounted on the toner refilling portion 10 rotates, the electrical contact state of the pair of electrodes 148-1 and 148-2 provided in the toner refilling portion 10 is changed from the electrical open state to the electrical short state and a voltage of 0 V may be applied to the first input port of the controller 300. Accordingly, the controller 300 may detect whether or not the toner refill cartridge 9 rotates based on the change in the voltage flowing through the second connector 127 depending on the rotation of the toner refill cartridge 9 with respect to the reference voltage VDD applied to the controller 300, and may control the image forming apparatus according to a result of the detection.

For example, the image forming apparatus 1000 may be controlled to output information regarding whether the toner refill cartridge 9 is mounted on the toner refilling portion 10. For example, a message may be presented on a screen of the user interface 1010 regarding a status of rotation or mounting of the toner refill cartridge 9, or a light indication may be provided, such as a green light indicating successful mounting of the toner refill cartridge 9 or a red light indicating an unsuccessful mounting of the toner refill cartridge 9. Further the output may be in the form of haptic feedback presented through the user interface 1010, or a sound generated by an output device 1020 such as a speaker, which may also provide a user information regarding whether the toner refill cartridge 9 is mounted on the toner refilling portion 10.

When the toner refill cartridge 9 is rotated to allow toner contained in the toner refill cartridge 9 to be injected into the toner container portion 230 of the image forming apparatus, a user may push the plunger 93 to refill toner into the toner container portion 230 through the toner refilling portion 10. Completion of the toner injection may be detected by the toner injection completion signal generator 92. When the plunger 93 enters the lower position Q2, the pushing protrusion 931 may push the operating lever 923 to bring the pair of electrodes 921 and 922 into contact with each other. One of the pair of electrodes 921 and 922 may be a fixed electrode and the other electrode may be an elastic electrode that can be elastically contacted/separated to/from the fixed electrode. Accordingly, 0 V may be applied to a second input port of the controller 300 to which the reference voltage of 3.3 V is applied until toner injection is completed. That is, 0 V may be applied to both the first input port and the second input port of the controller 300. Accordingly, the controller 300 may detect toner injection completion of the toner refill cartridge 9 based on the change in the voltage flowing through the second connector 127 depending on whether or not the toner injection of the toner refill cartridge 9 is completed with respect to the reference voltage VDD applied to the controller 300, and may control the image forming apparatus according to a result of the detection.

In order to remove the toner refill cartridge 9, the toner refill cartridge 9 may be rotated in a direction opposite to a direction in which the toner refill cartridge 9 is rotated after being mounted on the toner refilling portion 10. Accordingly, the inlet shutter 14 rotated together with the rotation of the toner refill cartridge 9 may be returned to its original position. A voltage of 1.65 V instead a voltage of 0 V may be applied to the first input port of the controller 300 again. When the toner injection of the toner refill cartridge 9 is completed and the toner refill cartridge 9 is unlocked by rotating the toner refill cartridge 9 in a direction opposite to a direction in which the toner refill cartridge 9 is rotated after being mounted on the toner refilling portion 10, a user may separate the toner refill cartridge 9 from the toner refilling portion 10. Accordingly, a signal of 3.3 V may be input to the first input port of the controller 300 again.

The image forming apparatus 1000 may be controlled to output information regarding the toner refill cartridge 9 being separated from the toner refilling portion 10. For example, a message may be presented on a screen of the user interface 1010 regarding a status of rotation or separation of the toner refill cartridge 9, or a light indication may be provided. Further the output may be in the form of haptic feedback presented through the user interface 1010, or a sound generated by an output device 1020 such as a speaker, which may also provide a user information regarding separation of the toner refill cartridge 9 from the toner refilling portion 10. The user interface 1010 and output device 1020 may be combined as a single device where the user interface 1010 includes the output device 1020 or vice versa.

Figure 11:
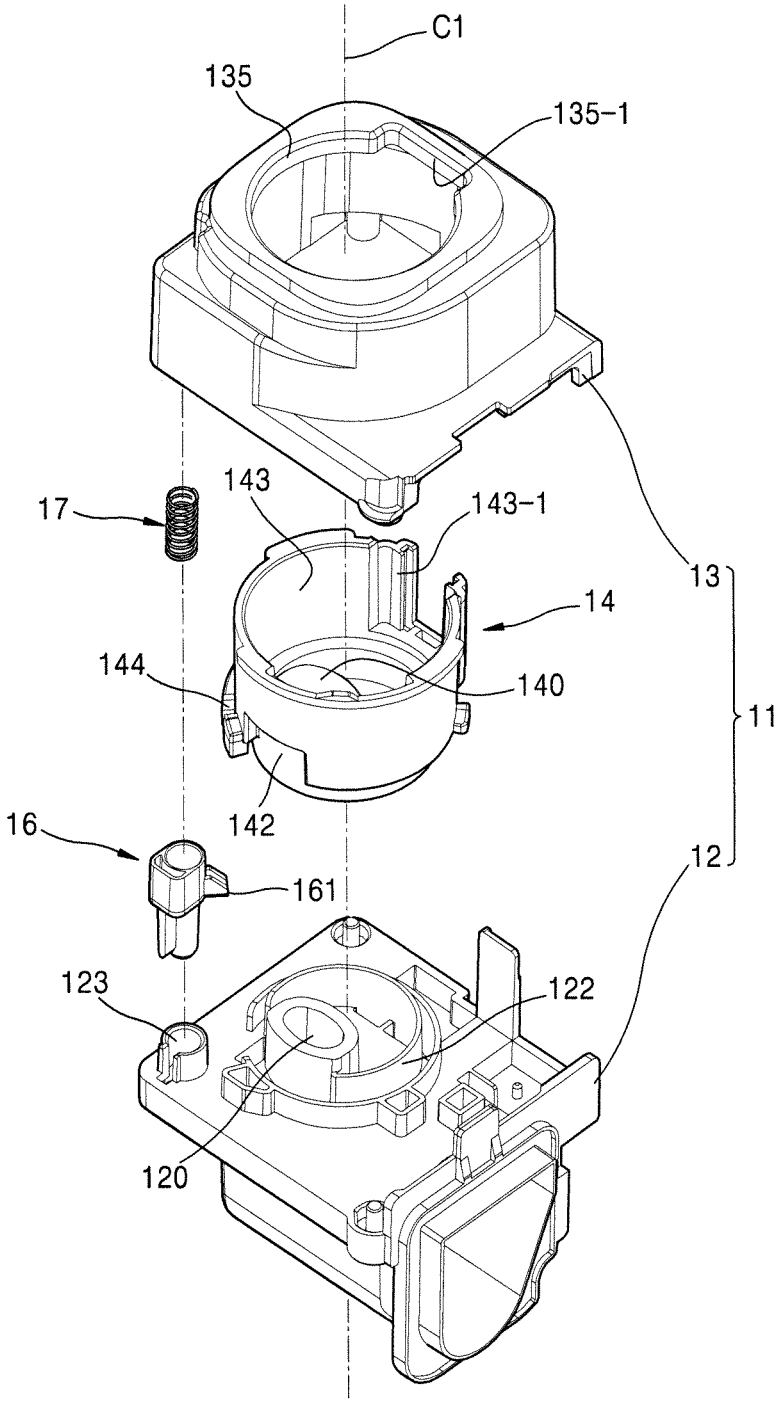
FIG. 11 is an exploded perspective view of a toner refilling portion according to an example.
Figure 12:
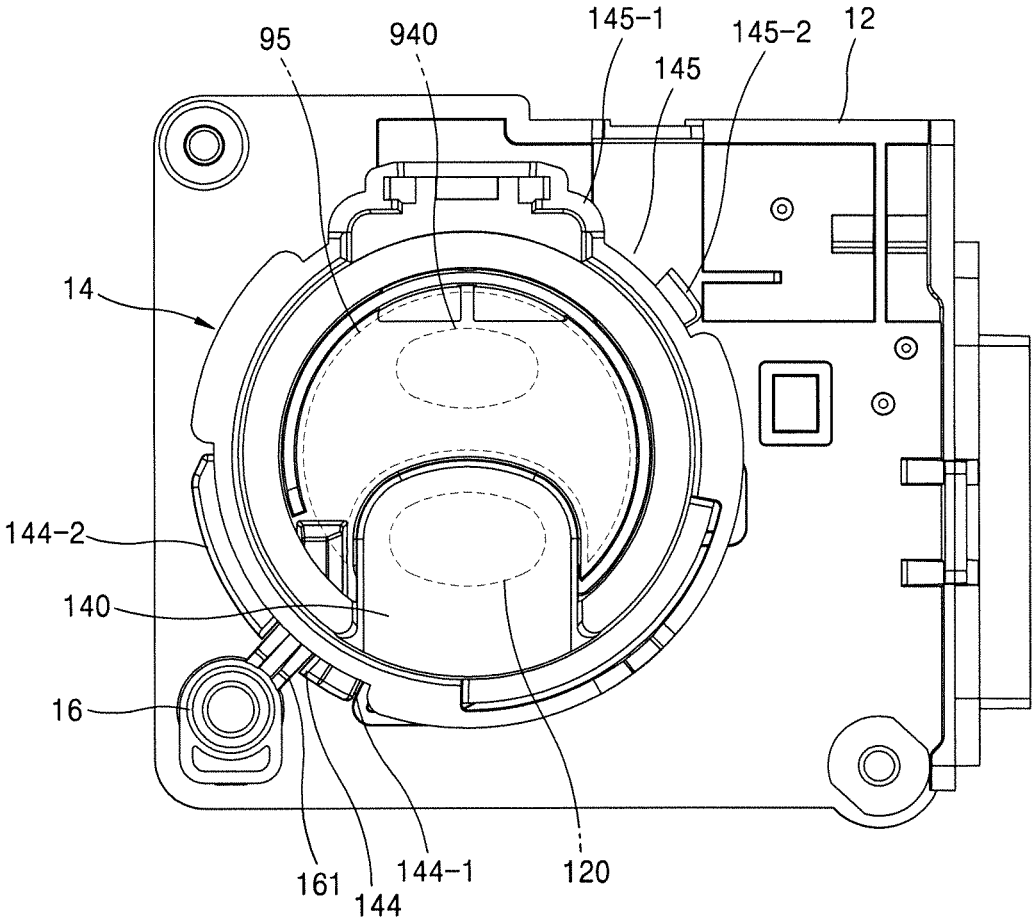
FIG. 12 illustrates an inlet shutter in a blocking position.
Figure 13:
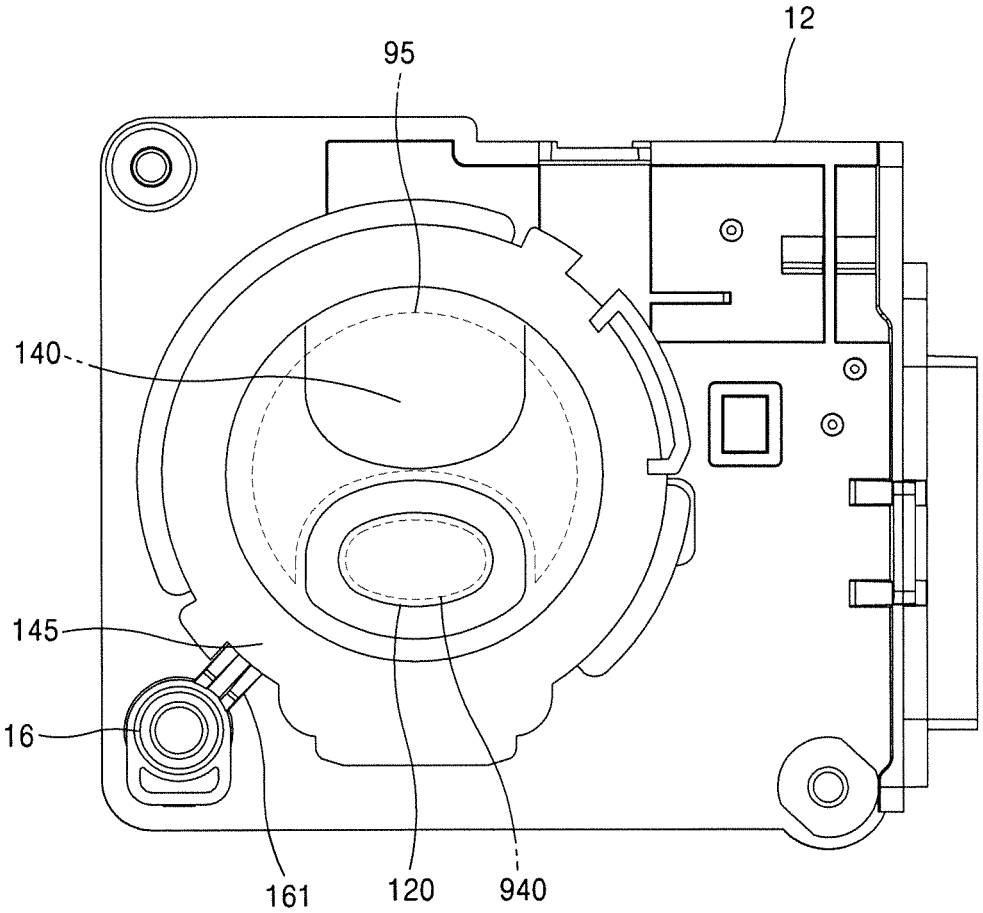
FIG. 13 illustrates an inlet shutter in an inlet position.

FIG. 11 is an exploded perspective view of the toner refilling portion 10 according to an example. FIG. 12 illustrates an inlet shutter 14 located in a blocking position. FIG. 13 illustrates the inlet shutter 14 located in an inlet position. In FIGS. 12 and 13, an upper body 13 is omitted.

Referring to FIGS. 6 and 11, the toner refilling portion 10 may include a mounting portion 11 in which the toner refill cartridge 9 is mounted, a toner inlet portion 120, and the inlet shutter 14.

The mounting portion 11 is connected to the toner container 230. The toner refill cartridge 9 that is inserted from outside the mounting portion 11 through the communicating portion 8 is mounted in the mounting portion 11. The toner inlet portion 120 is provided in the mounting portion 11 to receive toner from the toner cartridge 9. For example, the mounting portion 11 may include a lower body 12 and an upper body 13. The upper body 13 is coupled to the lower body 12. The lower body 12 is connected to the toner container 230. The toner inlet portion 120 is provided in the lower body 12.

The inlet shutter 14 is provided in the mounting portion 11 such that it is switchable between a blocking position (FIG. 12) where the toner inlet portion 120 is blocked and an inlet position (FIG. 13) where the toner inlet portion 120 is opened. The inlet shutter 14 may be rotated about the first rotational axis C1 to be switched between the blocking position and the inlet position. For example, the inlet shutter 14 may include a blocking portion 140. The inlet shutter 14 may be provided in the mounting portion 11 such that the inlet shutter 14 is rotatable about the first rotational axis C1 between the blocking position (FIG. 12) where the blocking portion 140 blocks the toner inlet portion 120 and the inlet position (FIG. 13) where the blocking portion 140 is offset from the toner inlet portion 120 to open the toner inlet portion 120.

For example, the inlet shutter 14 may be located between the lower body 12 and the upper body 13. The inlet shutter 14 may be rotatably supported by the lower body 12. A first cylindrical portion 122 that rotatably supports the inlet shutter 14 about the first rotational axis C1 is provided in the lower body 12. The first cylindrical portion 122 may be implemented using, for example, a cylindrical rib arranged about the first rotational axis C1 and protruding toward the upper body 13. The inlet shutter 14 includes a second cylindrical portion 142 surrounding the first cylindrical portion 122 and being rotatably supported by the first cylindrical portion 122. The upper body 13 is coupled to the lower body 12 to cover the inlet shutter 14.

The inlet shutter 14 includes a receiving portion 143 receiving the front end portion of the toner cartridge 9. The inlet shutter 14 has a shape that is rotatable with the toner refill cartridge 9 when the toner refill cartridge 9 is rotated about the first rotational axis C1. For example, a shape of the front end portion of the toner refill cartridge 9 may be complementary to a shape of the blocking portion 140. A groove 143-1 that is partially opened and protrudes outwardly to receive a protruding portion 912 of the toner refill cartridge 9 may be formed in the receiving portion 143. An insertion portion 135 and a key groove 135-1 that are respectively aligned with the receiving portion 143 and the groove 143-1 may be provided in the upper body 13. The receiving portion 143, the groove 143-1, the insertion portion 135, and the key groove 135-1 are aligned with each other when the inlet shutter 14 is located in the blocking position.

For example, as illustrated in FIG. 12, by aligning the protruding portion 912 with the key groove 135-1 while the inlet shutter 14 is in the blocking position, the toner refill cartridge 9 may be mounted in the mounting portion 11. Then the front end portion of the body 91 is received in the receiving portion 143 of the inlet shutter 14, and the protruding portion 912 is received in the groove 143-1, and the front end portion of the toner refill cartridge 9 and the blocking portion 140 are coupled to each other in a complementary manner. The blocking portion 140 covers the toner inlet portion 120. The toner discharging portion 940 of the toner refill cartridge 9 is located in an offset position from the toner inlet portion 120. The toner discharging portion 940 is blocked by the discharge shutter 95 illustrated in FIG. 4.

In this state, when the toner refill cartridge 9 is rotated about the first rotational axis C1, the inlet shutter 14 is rotated with the toner cartridge 9. Accordingly, the inlet shutter 14 may be rotated between the blocking position and the inlet position. When the toner refill cartridge 9 is rotated about the first rotational axis C1 such that the inlet shutter 14 deviates from the blocking position, the protruding portion 912 is located in a lower portion of a boundary of the insertion portion 135 of the upper body 13. In this state, even when attempting to forcibly separate the toner refill cartridge 9 from the mounting portion 11, since the protruding portion 912 is caught by the insertion portion 135, the toner refill cartridge 9 is not separated.

When the toner refill cartridge 9 is rotated about the first rotational axis C1 by 180 degrees, as illustrated in FIG. 13, the inlet shutter 14 is in the inlet position, and the blocking portion 140 is offset from the toner inlet portion 120, thereby opening the toner inlet portion 120. The discharge shutter 95 is caught by an outer portion of the toner inlet portion 120 and is thus not rotated, and the body 91, on the other hand, is rotated with respect to the discharge shutter 95 by, for example, 180 degrees. The toner discharging portion 940 of the toner refill cartridge 9 is opened, and the toner discharging portion 940 is aligned with the toner inlet portion 120. By pressing the plunger 93 in this state, toner may be supplied from the body 91 to the toner container 230 through the toner discharging portion 940 and the toner inlet portion 120.

The development cartridge 2 according to the example is an integration-type development cartridge 2 in which the toner refilling portion 10 is integrated, as illustrated in FIG. 3. The development cartridge 2 may be distributed during the product distribution stage while being mounted in the main body 1. The development cartridge 2 is a consumable item that is replaced when the life of the development cartridge 2 ends, and may be distributed separately from the main body 1. When the toner inlet portion 120 is opened in a distribution stage, toner contained in the toner container 230 may leak out. The leaked toner may contaminate the toner refilling portion 10. When the toner inlet portion 120 is opened during the distribution stage where the development cartridge 2 is distributed while being mounted in the main body 1, the inside of the main body 1 may be contaminated by the leaked toner.

Considering this, the image forming apparatus according to an example includes a first latch member 16 having a first position where the inlet shutter 14 is locked and a second position where switching or rotation of the inlet shutter 14 is allowed. A switching unit 18, which will be described later, selectively switches the first latch member 16 between the first position and the second position. In the example, the first latch member 16 is provided in the toner refilling portion 10, and the switching unit 18 is provided in the main body 1.

Referring to FIGS. 11, 12 and 13, the first latch member 16 may be provided in the mounting portion 11 such that the first latch member 16 is switched between the first position and the second position. The first latch member 16 may be moved in a direction of the first rotational axis C1 to be switched between the first position and the second position. For example, the first latch member 16 may be moved in a longitudinal direction parallel to the direction of the first rotational axis C1 in an upward and downward fashion. For example, referring to FIG. 11, an operation hole 123 extending in a direction of the first rotational axis C1 may be formed in the lower body 12. The first latch member 16 may be movably inserted into the operation hole 123 in a direction of the first rotational axis C1. A first latch spring 17 applies an elastic force to the first latch member 16 in a direction in which the first latch member 16 is located in the first position. The first latch spring 17 may be in various forms such as a coil spring, a leaf spring, or a resilient arm integrally formed with the first latch member 16. In the example, the first latch spring 17 may be implemented by a compression coil spring having a first end portion supported by the upper body 13 and a second end portion supported by the first latch member 16.

The first latch member 16 may lock the inlet shutter 14 in the blocking position. A first latching portion 144 is provided in the inlet shutter 14. The first latching portion 144 may be implemented by a pair of protrusions 144-1 and 144-2 that protrude outward from an outer circumference of the inlet shutter 14 and are spaced apart from each other in a circumferential direction. The first latch member 16 may include a latching protrusion 161 which is caught by the first latching portion 144 when the first latch member 16 is located in the first position. Referring to FIG. 12, when the inlet shutter 14 is located in the blocking position, the latching protrusion 161 of the first latch member 16 located in the first position is caught by the first latching portion 144, and the inlet shutter 14 is locked in the blocking position. The first latch member 16 may be held in the first position via the first latch spring 17 when the development cartridge 2 is separated from the main body 1. Thus, during distribution of the development cartridge 2 while being mounted in the main body 1 or apart from the main body 1, the toner inlet portion 120 may be maintained in a closed state, and thus, toner leakage may be prevented.

When the toner refill cartridge 9 is mounted in the mounting portion 11 and is rotated during refilling of toner, the inlet shutter 14 is also rotated so that the toner inlet portion 120 and the toner discharging portion 940 may be offset from each other. Then, the toner discharged through the toner discharging portion 940 may leak out of the toner inlet portion 120 to contaminate the toner refilling portion 10.

Considering this, the first latch member 16 may lock the inlet shutter 14 in the inlet position. Referring to FIGS. 12 and 13, a second latching portion 145 is provided on the inlet shutter 14. The second latching portion 145 may be implemented using a pair of protrusions 145-1 and 145-2 that protrude outwardly from the outer circumference of the inlet shutter 14 and are spaced apart from each other in a circumferential direction. As illustrated in FIG. 13, when the inlet shutter 14 is located in the inlet position, the latching protrusion 161 of the first latch member 16 located in the first position is caught by the second latching portion 145, and the inlet shutter 14 is locked in the inlet position. Accordingly, while the toner refill cartridge 9 is mounted in the mounting portion 11 and toner is being refilled, the inlet shutter 14 is not rotated, and the toner may be stably refilled in the toner container 230 without toner leakage.

The switching unit 18 selectively switches the first latch member 16 between the first position and the second position. For example, while the inlet shutter 14 is locked in the blocking position, when the toner refill cartridge 9 is mounted in the toner refilling portion 10, the switching unit 18 switches the first latch member 16 to the second position so that the inlet shutter 14 and the toner refill cartridge 9 may be rotated together. When the first latch member 16 is located in the second position, the latching protrusion 161 deviates from the first latching portion 144, and the inlet shutter 14 enters a state where it is rotatable. When the toner refill cartridge 9 is mounted in the toner refilling portion 10 and rotated by 180 degrees, so that the inlet shutter 14 is located in the inlet position, the switching unit 18 may switch the first latch member 16 to the first position. The latching protrusion 161 of the first latch member 16 is caught by the second latching portion 145 and the inlet shutter 14 is locked in the inlet position, and thus the toner refill cartridge 9 and the inlet shutter 14 are not rotated.

Figure 14:
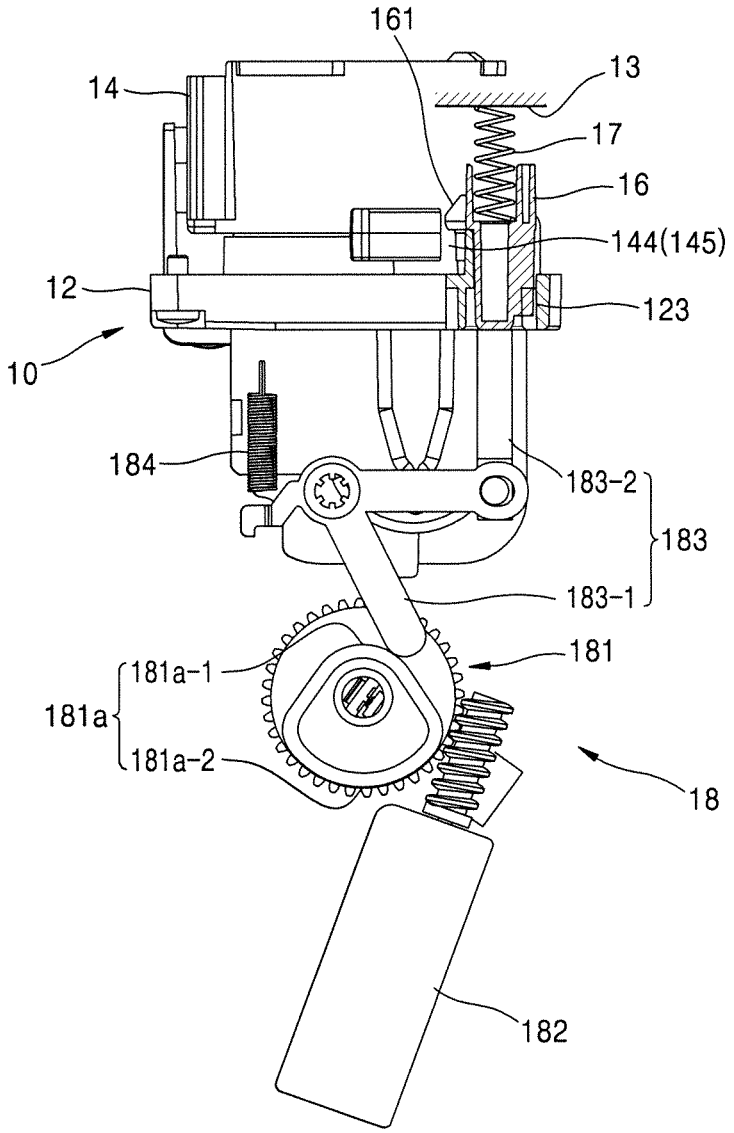
FIG. 14 is a schematic structural diagram of a switching unit according to an example, in which a first latch member is in a first position.
Figure 15:
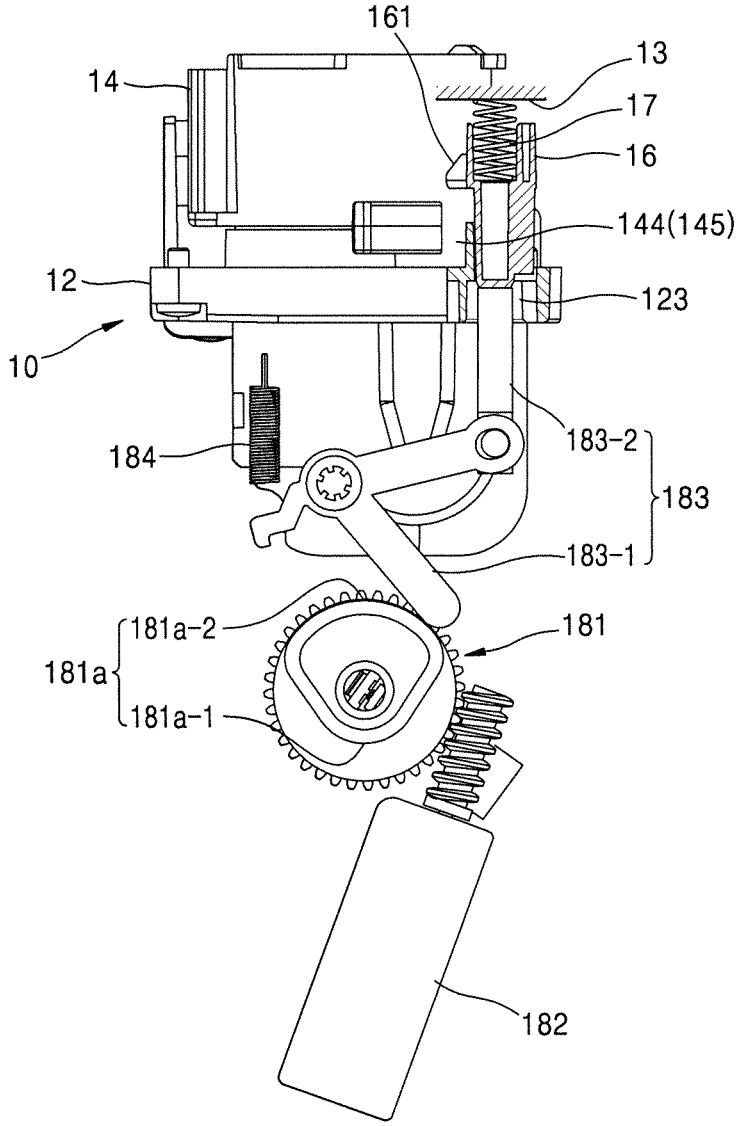
FIG. 15 is a schematic structural diagram of a switching unit according to an example, showing a first latch member in a second position.
Figure 16:
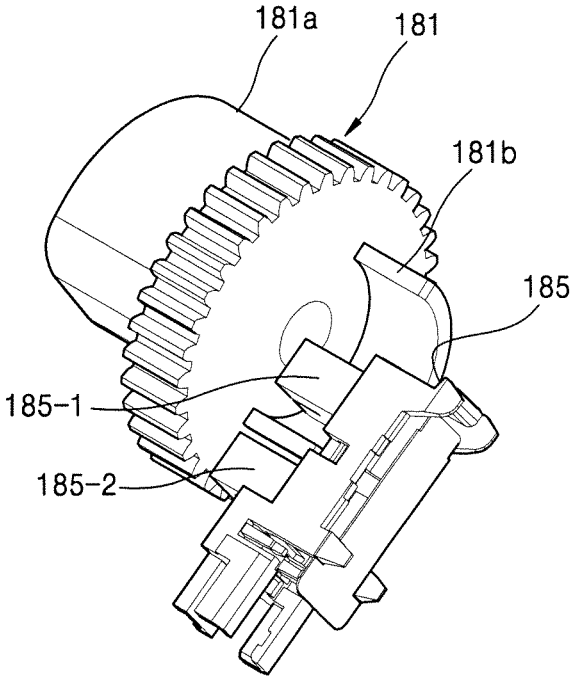
FIG. 16 illustrates a structure of detecting a phase of a rotational cam according to an example.

The switching unit 18 may be implemented in various forms. FIG. 14 is a schematic structural diagram of the switching unit 18 according to an example, showing the first latch member 16 located in the first position. FIG. 15 is a schematic structural diagram of the switching unit 18 according to an example, showing the first latch member 16 located in the second position. FIG. 16 illustrates a structure of detecting a phase of a rotational cam 181 according to an example. In FIGS. 14 and 15, portions of the upper body 13 are omitted.

Referring to FIGS. 14 and 15, the switching unit 18 includes a rotational cam 181 having a cam track 181*a*, a motor 182 rotating the rotational cam 181, and a movable member 183 guided to the cam track 181*a* to switch the first latch member 16 between the first and second positions. The cam track 181*a* may include first and second cam portions 181*a*-1 and 181*a*-2 respectively corresponding to the first and second positions of the first latch member 16. The movable member 183 may include a first movable member 183-1 guided to the cam track 181*a* to be pivoted and a second movable member 183-2 connected to the first movable member 183-1 to be lifted. When the development cartridge 2 is mounted in the main body 1, the second movable member 183-2 may be inserted into the operation hole 123 in which the first latch member 16 is installed, to thereby contact the first latch member 16. The cam spring 184 applies an elastic force to the movable member 183 in a direction in which the movable member 183 contacts the cam track 181*a*. According to the example, the cam spring 184 is implemented by using a tensile coil spring having a first end portion connected to the first movable member 183-1 and a second end portion supported by the main body 1. The first end portion of the first movable member 183-1 is maintained in contact with the cam track 181*a* via the cam spring 184. The motor 182 may be, for example, a direct current (DC) motor. For example, a worm gear may be mounted on a rotational axis of the motor 182. A worm wheel with which the worm gear engages may be provided to the rotational cam 181. When the motor 182 rotates, the rotational cam 181 may be rotated.

Referring to FIG. 16, the switching unit 18 may further include a sensor 185 detecting a phase of the rotational cam 181. For example, the sensor 185 may be implemented using a photo-interrupter including a light emitting portion 185-1 and a light receiving portion 185-2. A light shielding rib 181*b* blocking light between the light emitting portion 185-1 and the light receiving portion 185-2 according to a rotational phase may be provided in the rotational cam 181. For example, when light is blocked via the light shielding rib 181*b* and thus no light is detected from the light receiving portion 185-2, an ON detection signal may be generated in the light receiving portion 185-2; when light is detected from the light receiving portion 185-2, an OFF detection signal may be generated in the light receiving portion 185-2. For example, when an angle between two ends of the light shielding rib 181*b* is 180 degrees, the movable member 183 may be configured to be guided to the first cam portion 181*a*-1 of the rotational cam 181 in a moment when a detection signal of the light receiving portion 185-2 changes from ON to OFF, and the movable member 183 may be configured to be guided to the second cam portion 181*a*-2 of the rotational cam 181 in a moment when a detection signal of the light receiving portion 185-2 changes from OFF to ON. According to this configuration, a rotational phase of the rotational cam 181 may be detected, and the first latch member 16 may be positioned in the first position or the second position.

The motor 182 is driven in an initial state and stopped a moment when a detection signal of the light receiving portion 185-2 changes from ON to OFF. Then the movable member 183 is guided to the first cam portion 181*a*-1, and the movable member 183 moves away from the first latch member 16, and accordingly, due to an elastic force of the first latch spring 17, the first latch member 16 is located in the first position as illustrated in FIG. 14. As the latching protrusion 161 of the first latch member 16 is caught by the first latching portion 144 or the second latching portion 145 of the inlet shutter 14, the inlet shutter 14 is locked in the blocking position or the inlet position.

To allow rotation of the inlet shutter 14, the motor 182 is driven and then stopped a moment when a detection signal of the light receiving portion 185-2 changes from OFF to ON. Then the movable member 183 is guided to the second cam portion 181*a*-2, and the movable member 183 pushes the first latch member 16 in an opposite direction to the elastic force of the first latch spring 17. Then, as illustrated in FIG. 15, the first latch member 16 is located in the second position. As the latching protrusion 161 of the first latch member 16 deviates upwards from the first latching portion 144 or second latching portion 145 of the inlet shutter 14, the inlet shutter 14 may be rotated from the blocking position to the inlet position or in an opposite direction thereto.

Figure 17:
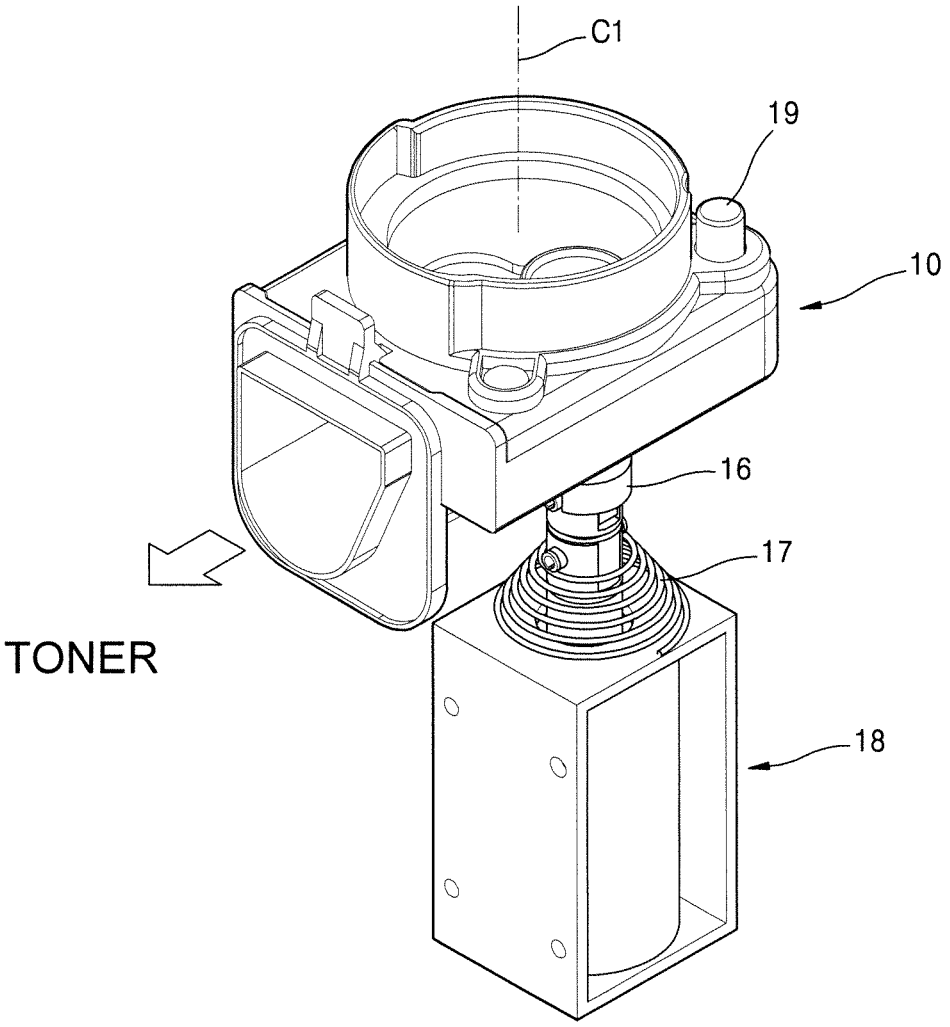
FIG. 17 is a perspective view of a structure in which a first latch member and a switching unit are provided in a main body, according to an example.
Figure 18:
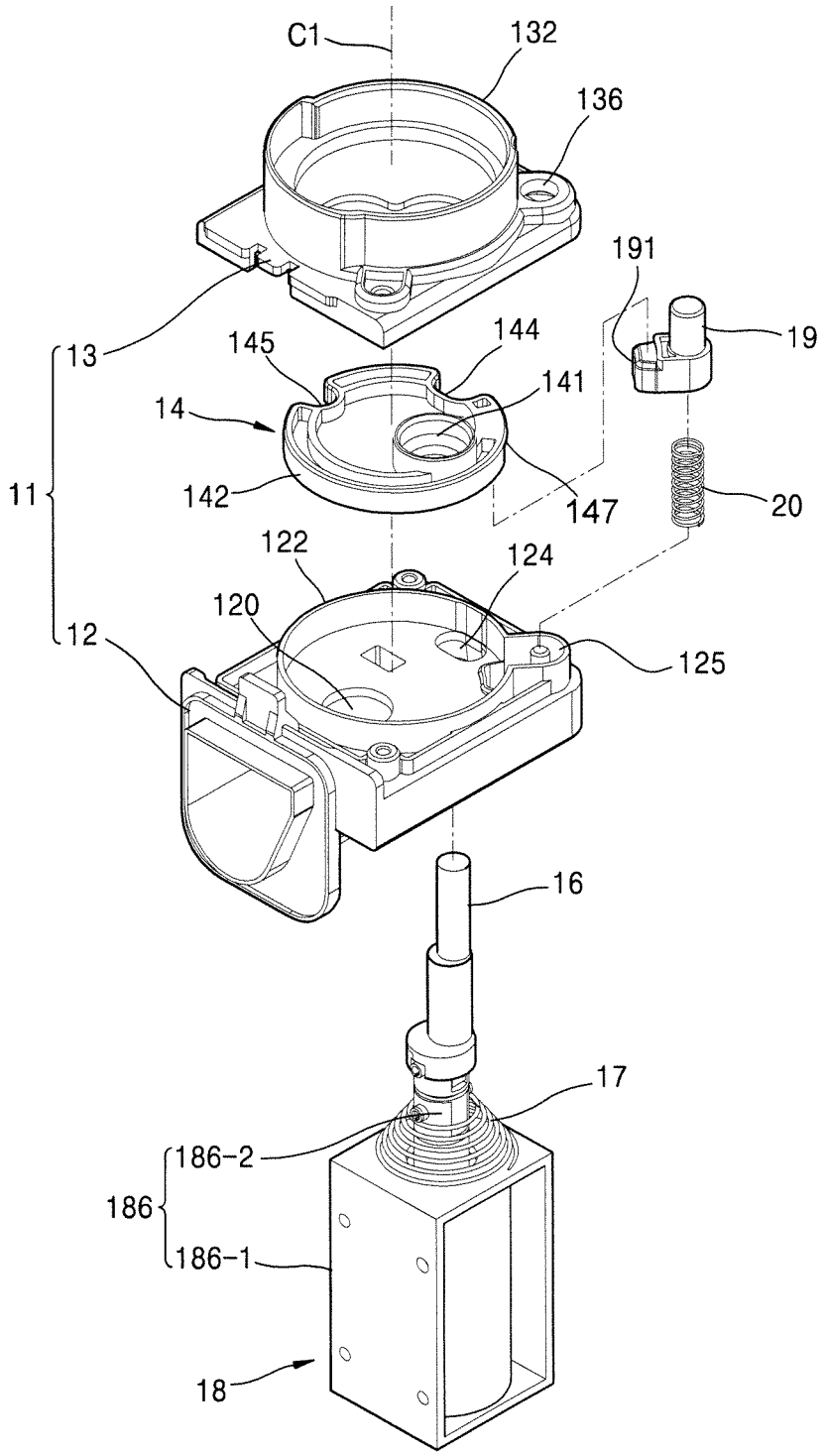
FIG. 18 is an exploded perspective view of the structure in which the first latch member and the switching unit are provided in the main body, illustrated in FIG. 12, according to an example.
Figure 19:
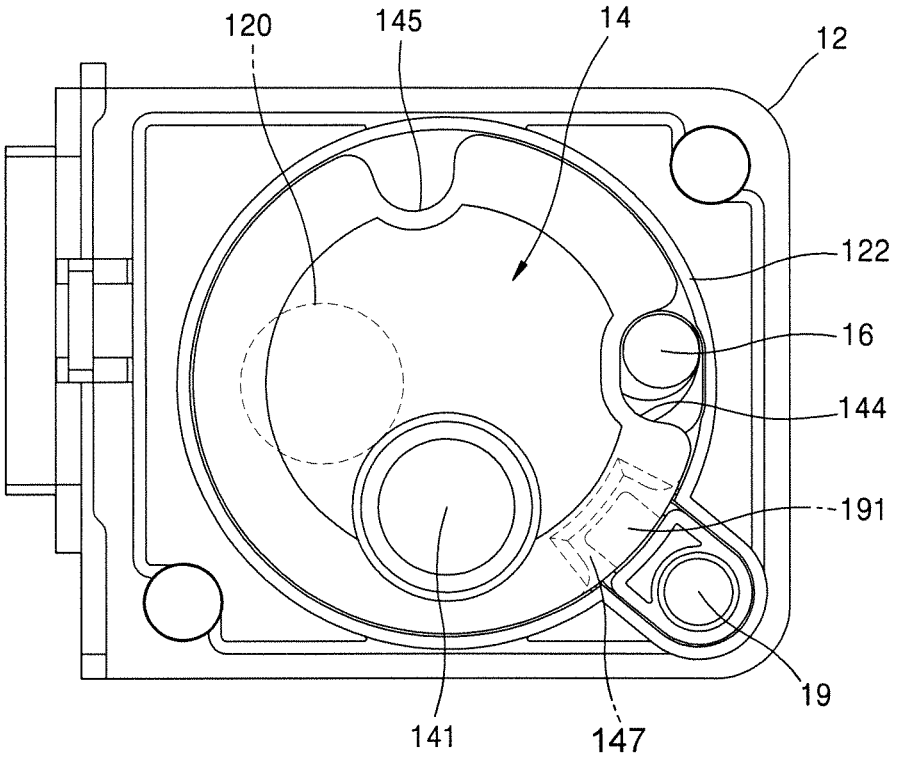
FIG. 19 illustrates an inlet shutter in a blocking position.
Figure 20:
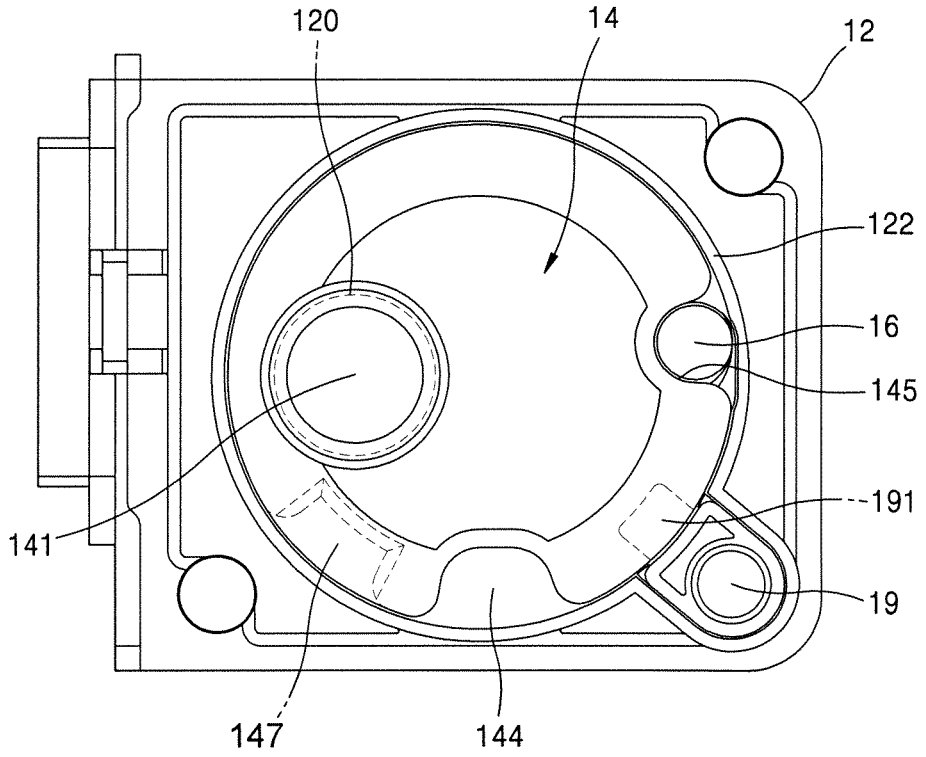
FIG. 20 illustrates an inlet shutter in an inlet position.
Figure 21:
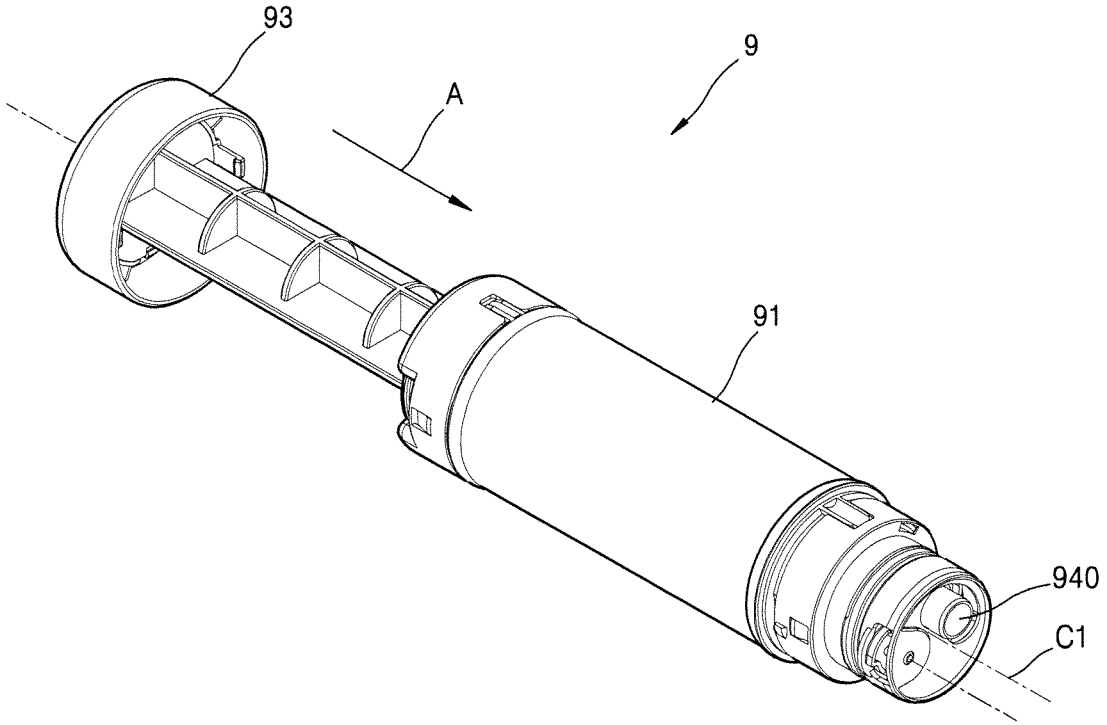
FIG. 21 is a schematic perspective view of a toner cartridge according to an example.

The first latch member 16 and the switching unit 18 may also be provided in the main body 1. FIG. 17 is a perspective view of a structure in which the first latch member 16 and the switching unit 18 are provided in the main body 1, according to an example. FIG. 18 is an exploded perspective view of the structure of FIG. 17. FIG. 19 illustrates the inlet shutter 14 located in the blocking position. FIG. 20 illustrates the inlet shutter 14 located in the inlet position. FIG. 21 is a schematic perspective view of the toner refill cartridge 9 according to an example. In FIGS. 17 and 18, the toner refilling portion 10, the first latch member 16, and the switching unit 18 are illustrated. In FIGS. 19 and 20, the upper body 13 is omitted. Elements having an identical function as those described in the above-described examples will be labeled with identical reference numerals.

Referring to FIG. 21, the toner refill cartridge 9 may be a syringe-type toner refill cartridge including a body 91 containing toner and including a toner discharging portion 940 and a plunger 93 that is movably coupled to the body 91 in a length direction A to pull the toner out of the body 91. The toner discharging portion 940 may be provided at a front end portion of the body 91. The toner discharging portion 940 may be eccentrically positioned from the first rotational axis C1. The body 91 may be, for example, cylindrical. The first rotational axis C1 may be a central axis of a cylindrical body 91. The first rotational axis C1 may be a rotational central axis about which the toner refill cartridge 9 mounted on the toner refilling portion 10 is rotated. A discharge shutter (not shown) selectively opens or closes the toner discharging portion 940. When pressing the plunger 93 in direction A while the toner refill cartridge 9 is mounted in the toner refilling portion 10, the toner may be supplied from the body 91 to the toner container 230 of the development cartridge 2 through the toner refilling portion 10.

Referring to FIGS. 17, 18, 19, and 20, the toner refilling portion 10 may include a mounting portion 11 in which the toner refill cartridge 9 is mounted, a toner inlet portion 120, and an inlet shutter 14.

The mounting portion 11 is connected to the toner container 230. The toner refill cartridge 9 that is inserted from outside the mounting portion 11 through the communicating portion 8 is mounted in the mounting portion 11. A toner inlet portion 120 is provided in the mounting portion 11 to receive toner from the toner cartridge 9. For example, the mounting portion 11 may include a lower body 12 and an upper body 13. The upper body 13 is coupled to the lower body 12. The lower body 12 is connected to the toner container 230. The toner inlet portion 120 is provided in the lower body 12.

The inlet shutter 14 is provided in the mounting portion 11 such that the inlet shutter 14 is switchable between the blocking position (FIG. 19) where the toner inlet portion 120 is blocked and the inlet position (FIG. 20) where the toner inlet portion 120 is opened. The inlet shutter 14 may be rotated about the first rotational axis C1 between the blocking position and the inlet position. For example, the inlet shutter 14 may include a second toner inlet portion 141. The inlet shutter 14 may be provided in the mounting portion 11 such that the inlet shutter 14 is rotatable about the first rotational axis C1 between the blocking position where the toner inlet portion 120 and the second toner inlet portion 141 are offset from each other to block the toner inlet portion 120 and the inlet position where the toner inlet portion 120 and the second toner inlet portion 141 are aligned with each other to open the toner inlet portion 120. The second toner inlet portion 141 is aligned with the toner discharging portion 940 of the toner cartridge 9.

For example, the inlet shutter 14 may be located between the lower body 12 and the upper body 13. The inlet shutter 14 may be rotatably supported by the lower body 12. The lower body 12 has a first cylindrical portion 122 that rotatably supports the inlet shutter 14 about the first rotational axis C1. The first cylindrical portion 122 may be, for example, a cylindrical rib arranged about the first rotational axis C1 and protruding toward the upper body 13. The inlet shutter 14 is supported by the lower body 12 such that the second cylindrical portion 142 forming an outer circumference of the inlet shutter 14 is located within the first cylindrical portion 122. The upper body 13 is coupled to the lower body 12 to cover the inlet shutter 14.

The upper body 13 may have a structure in which the toner refill cartridge 9 may be rotatably supported. For example, a receiving portion 132 having a cylindrical shape and receiving the front end portion of the toner refill cartridge 9 may be provided in the upper body 13. The receiving portion 132 may be, for example, a cylindrical rib arranged about the first rotational axis C1 and protruding upwardly. When the toner refill cartridge 9 is mounted in the mounting portion 11, the front end portion of the toner refill cartridge 9 is received in the receiving portion 132, and the toner discharging portion 940 is inserted into the second toner inlet portion 141 of the inlet shutter 14. In this state, when the toner refill cartridge 9 is rotated about the first rotational axis C1, the inlet shutter 14 is rotated with the toner cartridge 9. Accordingly, the inlet shutter 14 may be rotated between the blocking position and the inlet position.

As illustrated in FIG. 19, while the inlet shutter 14 is located in the blocking position, the toner refill cartridge 9 is mounted in the mounting portion 11. The toner discharging portion 940 is inserted into the second toner inlet portion 141. As the second toner inlet portion 141 and the toner inlet portion 120 are offset from each other, even when a discharge shutter opens the toner discharging portion 940, toner does not flow into the toner inlet portion 120. In this state, when the toner refill cartridge 9 is rotated about the first rotational axis C1 by 90 degrees, as illustrated in FIG. 20, the inlet shutter 14 is in the inlet position, and the second toner inlet portion 141 is aligned with the toner inlet portion 120, thereby opening the toner inlet portion 120. When the discharge shutter (not shown) opens the toner discharging portion 940 and presses the plunger 93, toner may be supplied to the toner container 230 from the body 91 through the toner discharging portion 940, the second toner inlet portion 141, and the toner inlet portion 120.

The image forming apparatus according to the example includes the first latch member 16 having a first position where the inlet shutter 14 is locked and a second position where switching of the inlet shutter 14 is allowed. The switching unit 18 selectively switches the first latch member 16 between the first position and the second position. According to the example, the first latch member 16 and the switching unit 18 are provided in the main body 1.

Referring to FIG. 18, the first latch member 16 may be moved in a direction of the first rotational axis C1 to be switched between the first position and the second position. When the development cartridge 2 is mounted in the main body 1, the first latch member 16 is inserted, for example, into a through hole 124 provided in the lower body 12.

The first latch member 16 may lock the inlet shutter 14 in the blocking position. Referring to FIGS. 18 and 19, a first latching portion 144 whereby the first latch member 16 located in the first position is caught when the inlet shutter 14 is located in the blocking position is provided in the inlet shutter 14. When the inlet shutter 14 is located in the blocking position, the first latching portion 144 is aligned with the first latch member 16, and when the first latch member 16 is switched to the first position via the switching unit 18 which will be described later, the first latch member 16 may be caught by the first latching portion 144, thereby locking the inlet shutter 14 in the blocking position. Thus, during distribution of the development cartridge 2 mounted in the main body 1, the toner inlet portion 120 may be maintained in a closed state, and thus, toner leakage may be prevented.

The first latch member 16 may lock the inlet shutter 14 in the inlet position. Referring to FIGS. 18 and 20, the second latching portion 145 whereby the first latch member 16 located in the first position is caught when the inlet shutter 14 is located in the inlet position is provided in the inlet shutter 14. When the inlet shutter 14 is located in the inlet position, the second latching portion 145 is aligned with the first latch member 16, and when the first latch member 16 is switched to the first position via the switching unit 18 which will be described later, the first latch member 16 may be caught by the second latching portion 145, thereby locking the inlet shutter 14 in the inlet position. Accordingly, while the toner refill cartridge 9 is mounted in the mounting portion 11 and toner is being refilled, the inlet shutter 14 is not rotated, and the toner may be stably refilled in the toner container 230 without toner leakage.

Referring to FIGS. 17 and 18, the switching unit 18 may include a solenoid 186 via which the first latch member 16 is switched between the first and second positions. The solenoid 186 may include a solenoid body 186-1 and a driving shaft 186-2. The first latch member 16 is connected to the driving shaft 186-2. A first latch spring 17 applies an elastic force to the first latch member 16 in a direction in which the first latch member 16 is located in the first position. According to the example, the first latch spring 17 is implemented by a compression coil spring interposed between the driving shaft 186-2 and the solenoid body 186-1. The first latch spring 17 applies an elastic force to the driving shaft 186-2 in a direction in which the first latch member 16 is located in the first position. That is, the first latch spring 17 pushes the driving shaft 186-2 towards the first latch member 16.

When a current is supplied to the solenoid body 186-1, the driving shaft 186-2 is pulled in an opposite direction of the elastic force of the first latch spring 17, that is, toward the solenoid body 186-1. The first latch member 16 is moved from the first position to the second position. When no current is applied to the solenoid body 186-1, the driving shaft 186-2 is pushed toward the first latch member 16 due to the elastic force of the first latch spring 17 and the first latch member 16 is moved from the second position to the first position.

As described above, according to the switching unit 18 including the solenoid 186, by supplying or blocking a current to or from the solenoid 186, the first latch member 16 may be switched between the second position and the first position.

Referring back to FIG. 18, a third latching portion 147 may be provided in the inlet shutter 14. A second latch member 19 has a third position where the second latch member 19 is caught by the third latching portion 147 when the inlet shutter 14 is located in the blocking position to lock the inlet shutter 14 and a fourth position where the second latch member 19 is released from the third latching portion 147. For example, the second latch member 19 may be liftably mounted in a direction of the first rotational axis C1 in the operation hole 125 of the lower body 12 that extends in a direction of the first rotational axis C1. The third latching portion 147 may be concavely formed in an upward direction from a lower surface of the inlet shutter 14. A latching portion 191 that is caught by the third latching portion 147 when the second latch member 19 is located in the third position is formed on the second latch member 19. A second latch spring 20 applies an elastic force to the second latch member 19 in a direction in which the second latch member 19 is located in the third position. Thus, when the development cartridge 2 is separated from the main body 1, the second latch member 19 may be maintained in the third position.

When the first latch member 16 and the switching unit 18 are provided in the main body 1, and when the development cartridge 2 is separated from the main body 1, the inlet shutter 14 may not be locked in the blocking position. In addition, also when the development cartridge 2 is distributed separately from the main body 1, the inlet shutter 14 may not be locked in the blocking position. According to the example, when the development cartridge 2 is separated from the main body 1, the inlet shutter 14 may be locked in the blocking position via the second latch member 19.

Figure 22:
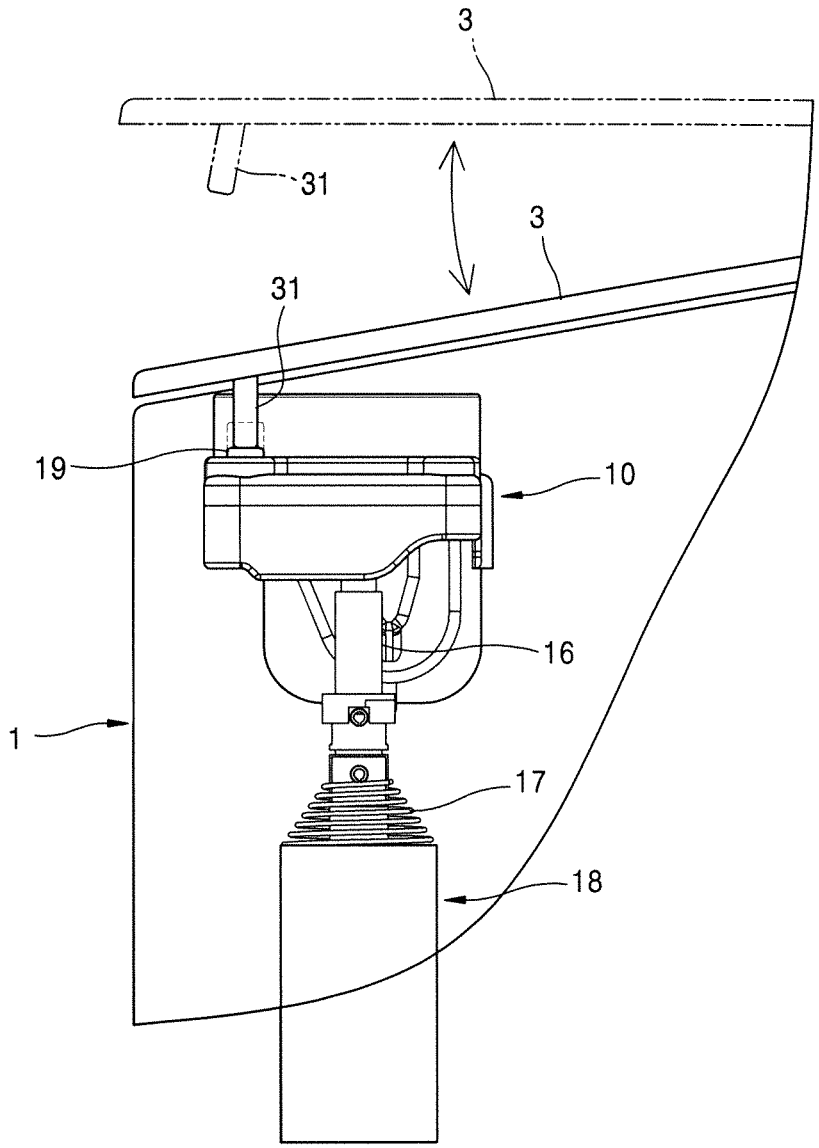
FIG. 22 is a partial perspective view of a structure of switching a second latch member to a fourth position, according to an example.

When the development cartridge 2 is mounted in the main body 1, the second latch member 19 is switched to the fourth position. Switching of the second latch member 19 to the fourth position may be performed in conjunction with a closing operation of the door 3. FIG. 22 is a partial perspective view of a structure of switching the second latch member 19 to the fourth position, according to an example. Referring to FIGS. 17, 18, and 22, the second latch member 19 protrudes upwardly from the upper body 13 through a through hole 136 formed in the upper body 13. The door 3 is provided in the main body 1 to open or close a portion of the main body 1 to attach/detach the development cartridge 2 to/from the main body 1. According to the example, the door 3 partially opens an upper portion of the main body 1. A releasing member 31 that switches the second latch member 19 to the fourth position via a closing operation of the door 3 is provided in the door 3. For example, the releasing member 31 may be protruded from an inner surface of the door 3 and press the second latch member 19 in an opposite direction to the elastic force of the second latch spring 20 when the door 3 is closed, thereby switching the second latch member 19 to the fourth position. By opening the door 3, the releasing member 31 is spaced apart from the second latch member 19, and the second latch member 19 may return from the fourth position to the third position via the elastic force of the second latch spring 20 and be maintained in the third position.

According to this configuration, when the development cartridge 2 is separated from the main body 1, the inlet shutter 14 may be locked in the blocking position via the second latch member 19. As the development cartridge 2 is mounted in the main body 1, the releasing member 31 presses the second latch member 19 via a closing operation of the development cartridge 2, thereby switching the second latch member 19 to the fourth position. Accordingly, according to operation of the first latch member 16 and the switching unit 18, the inlet shutter 14 may be locked in the blocking position or the inlet position, and rotated from the blocking position to the inlet shutter 14 or in an opposite direction thereto.

Figure 23:
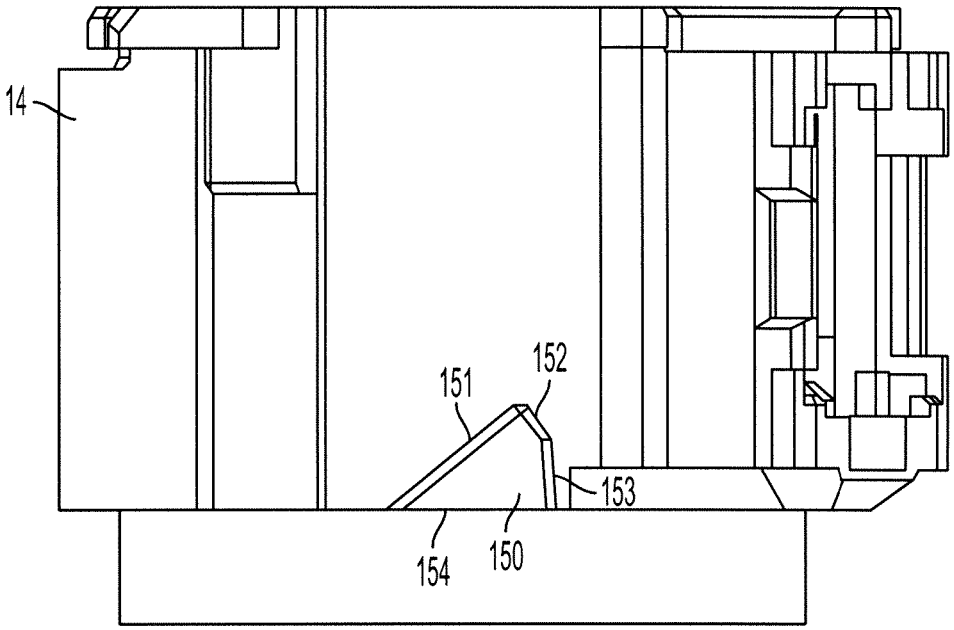
FIG. 23 is a side view of an inlet shutter, according to an example.

Referring now to FIG. 23, a side view of an inlet shutter according to an example is illustrated. As shown in FIG. 23, the inlet shutter 14 may further include a shutter protrusion 150 provided on a surface of the inlet shutter to, while the inlet shutter 14 is rotated, contact an object and cause feedback indicating whether the inlet shutter 14 is rotated to a predetermined position, for example, the inlet position. The shutter protrusion 150 may be provided at a lower portion of the outer circumferential surface of the inlet shutter. 14. As illustrated in FIG. 23, the shutter protrusion 150 may have a ramp or wedge shape including a first portion 151 inclined at a first angle, a second portion 152 inclined at a second angle, and a third portion 153 inclined at a third angle. The shutter protrusion 150 may further include a fourth portion 154 which is flat. The shutter protrusion 150 may be attached to the outer circumferential surface of the inlet shutter 14 and may be formed such that an inner side facing the outer circumferential surface of the inlet shutter 14 conforms to the cylindrical shape of the inlet shutter 14 and closely adheres to the inlet shutter 14. The shutter protrusion 150 may be integrally formed together with the inlet shutter 14, or may be attached to the inlet shutter 14 by a fixing member such as an adhesive or by a screw, for example. The disclosure is not limited to the shutter protrusion 150 illustrated in FIG. 23 and the shutter protrusion 150 may be in the form of other shapes such as a triangle shape in which there is a first portion inclined at a first angle similar to the first portion 151, a second portion inclined at a second angle similar to the second portion 152 or third portion 153, and a third portion which is flat similar to the fourth portion 154.

As an example, dimensions of the shutter protrusion 150 include a length of the first portion 151 being about 8.6 mm, a length of the second portion 152 being about 2.5 mm, a length of the third portion 153 being about 3.5 mm, and a length of the fourth portion 154 being about 8.3 mm. An angle between the first portion 151 and the fourth portion 154, the first angle, may be about 40 degrees. An angle between the first portion 151 and the second portion 152 may be about 94 degrees such that an angle between the second portion 152 and the fourth portion 154, the second angle, is about 46 degrees. An angle between the second portion 152 and the third portion 153 may be about 148 degrees such that an angle between the third portion 153 and the fourth portion 154, the third angle, is about 78 degrees. The shutter protrusion 150 may protrude outward from the inlet shutter 14 by about 2.6 mm. A height of the inlet shutter 14 may be about 30 mm. However, the disclosure is not so limited and the respective dimensions of the shutter protrusion 150 and inlet shutter 14 may vary, though a height of the shutter protrusion 150 may be affected by an amount by which the object is to be raised or lowered or by a height of the inlet shutter 14.

FIGS. 24A-24D are partial perspective views illustrating a rotation of the inlet shutter 14 having the shutter protrusion 150. Referring to FIGS. 24A-24D, an interaction between the shutter protrusion 150 and an object while the inlet shutter 14 is rotated, is illustrated. As discussed above, rotation of the inlet shutter 14 about the first rotational axis C1 can occur when the toner refill cartridge 9 is mounted to the toner refilling portion 10 and the toner refill cartridge 9 rotated. For example, when the toner refill cartridge 9 is rotated about the first rotational axis C1, the inlet shutter 14 is rotated with the toner cartridge 9. Accordingly, the inlet shutter 14 may be rotated between the blocking position and the inlet position. Rotation of the toner refill cartridge 9 may be performed manually, for example, by a user manually rotating the toner cartridge 9, which causes the inlet shutter 14 to also be rotated. For example, the toner refill cartridge 9 can be rotated about the first rotational axis C1 by 180 degrees, as illustrated in FIGS. 12-13, to rotate the inlet shutter 14 to the inlet position, where the blocking portion 140 is offset from the toner inlet portion 120. Or, the toner refill cartridge 9 can be rotated about the first rotational axis C1 by 90 degrees, as illustrated in FIGS. 19-20, to rotate the inlet shutter 14 to the inlet position, where the toner inlet portion 120 and second toner inlet portion 141 are aligned.

The shutter protrusion 150 may be applied to the inlet shutter 14 illustrated in FIGS. 12-13 as well as the inlet shutter 14 illustrated in FIGS. 19-20. According to an example, the object may correspond to the latching protrusion 161 or the latching portion 191. For ease of explanation, an example where the object corresponds to the latching protrusion 161 is explained below, and the concepts applicable to latching protrusion 161 which is formed on the first latch member 16 may also be applied to the latching portion 191 which is formed on the second latch member 19, though a height of the inlet shutter 14 as illustrated in FIG. 18 may be increased to accommodate the vertical motion of the latching protrusion 191 when interacting with the shutter protrusion 150.

Figure 24A:
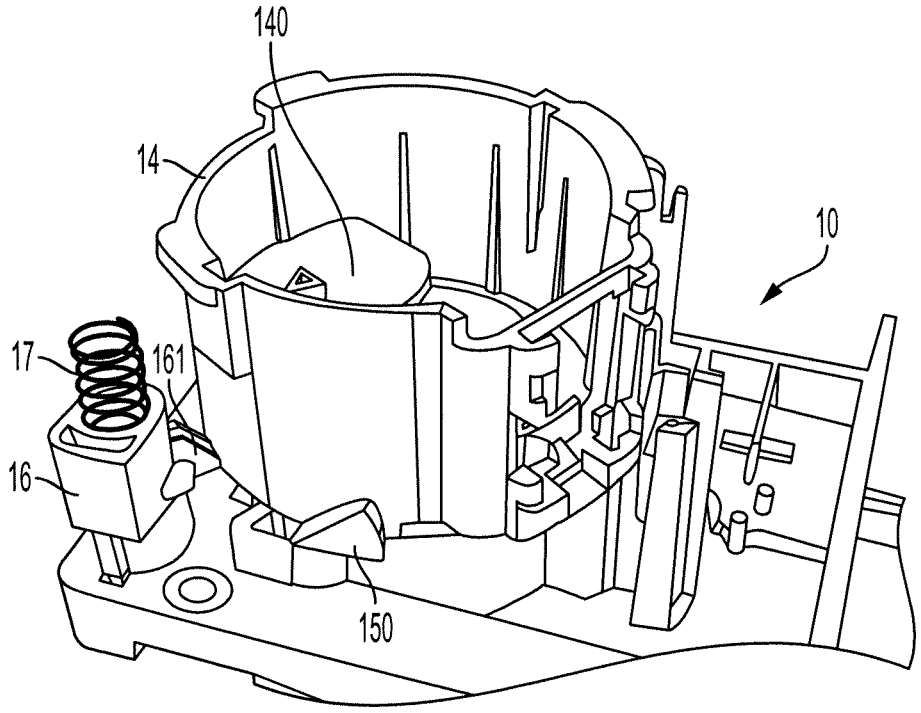
FIGS. 24A-24D are partial perspective views illustrating rotation of an inlet shutter of a toner refilling portion, according to an example.
Figure 24B:
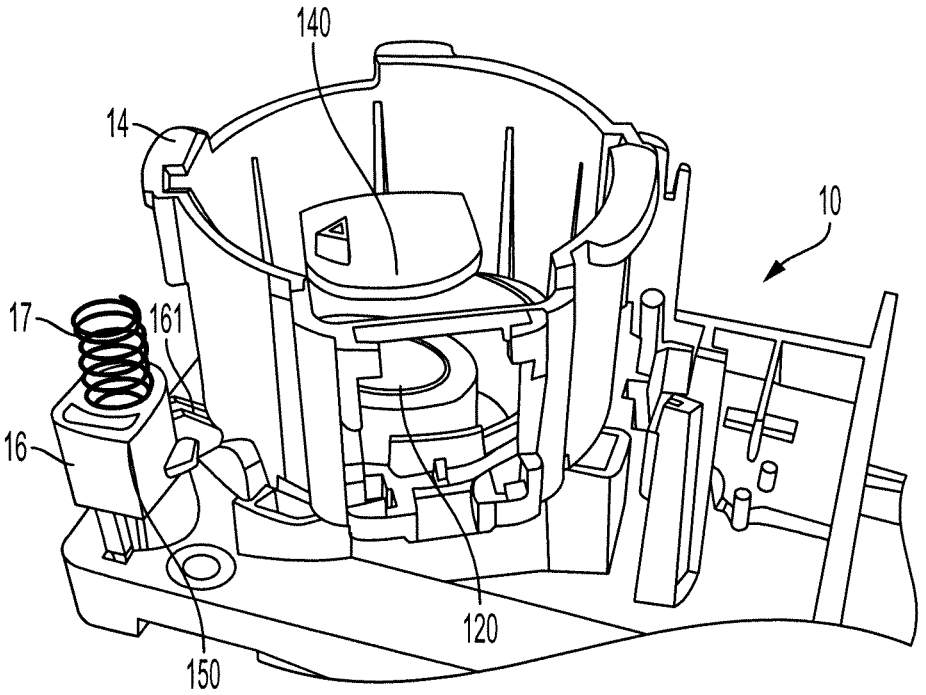
Figure 24C:
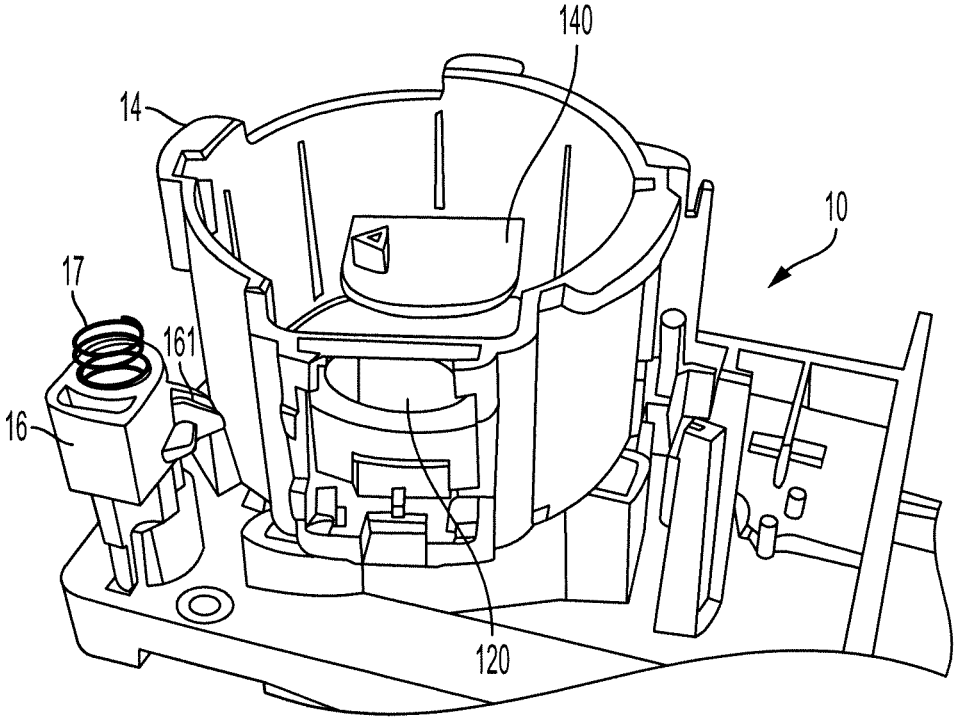
Figure 24D:
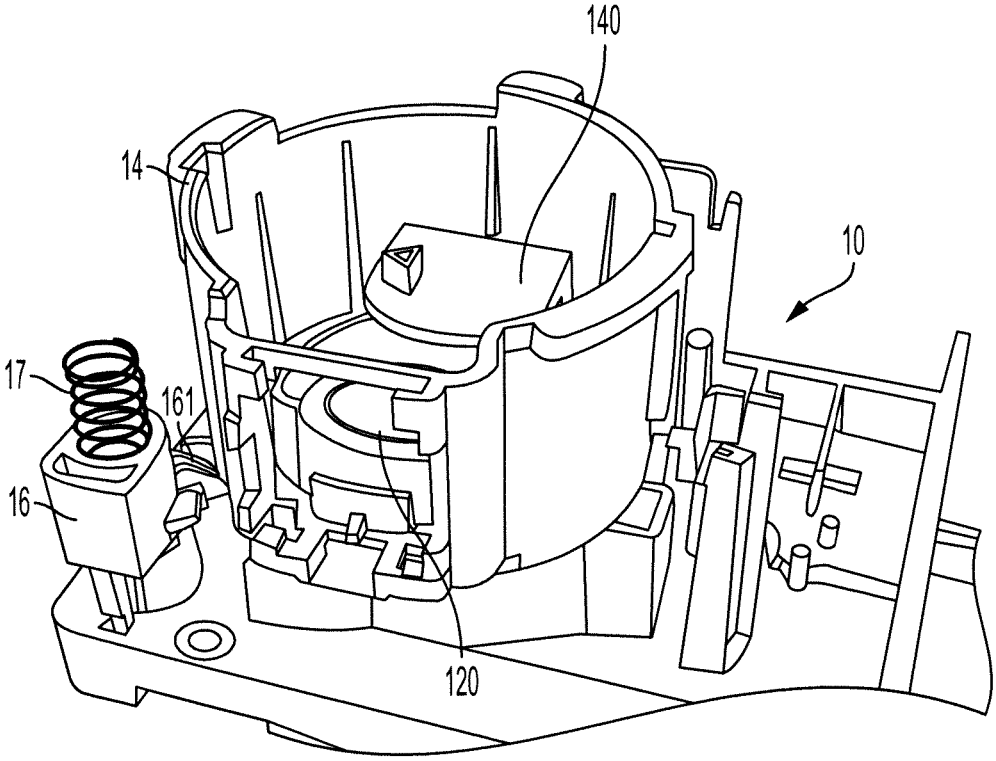

As illustrated in FIGS. 24A-24D, during rotation of the inlet shutter 14 to the inlet position (FIG. 24D), the first portion 151 of the shutter protrusion 150 initially makes contact with an object of the toner refilling portion 10 (FIG. 24B). In this example, the object corresponds to the latching protrusion 161. The latching protrusion 161 is formed on the first latch member 16 that is movable in an upward and downward direction parallel to the rotational axis C1. Because the shutter protrusion 150 has a ramp or wedge shape, when the first portion 151 of the shutter protrusion 150 contacts the latching protrusion 161 while the inlet shutter 14 is rotated, the first latch member 16 and the latching protrusion 161 are lifted upwardly and the latching protrusion 161 slides along the first portion 151 of the shutter protrusion 150 until reaching the second portion 152 of the shutter protrusion 150 (FIG. 24C). As illustrated in FIG. 24C, the first latch spring 17 may be compressed against the upper body 13 (not shown). At that point the first latch member 16 and the latching protrusion 161 begin to descend and the latching protrusion 161 slides along the second portion 152 of the shutter protrusion 150 and subsequently slides along the third portion 152 of the shutter protrusion 150 until the shutter protrusion 150 has transitioned past the latching protrusion 161 and coincidentally the inlet shutter 14 is in the inlet position where the toner inlet portion 120 is offset from the blocking portion 140 (FIG. 24D). Furthermore, as illustrated in FIG. 24D, the first latch spring 17 may be decompressed. The angle of the second portion 152 may be less steep than the angle of the third portion 153, for example to provide a smoother transition of the shutter protrusion 150 and to provide a less jarring effect to a user turning the toner cartridge 9.

The interaction of the shutter protrusion 150 with the latching protrusion 161 provides a user with feedback regarding the status of the rotation of the toner refill cartridge 9 and inlet shutter 14 such that a user can ascertain whether the toner refill cartridge 9 is successfully mounted to the toner refilling portion 10 and the toner refilling portion 10 is ready to receive toner from the toner refill cartridge 9. The interaction between the shutter protrusion 150 and the latching protrusion 161 as well as the raising and dropping of the first latch member 16, may produce an audible noise, such as an audible clicking noise, that a user can hear. This noise can indicate to the user that the toner refill cartridge 9 has been successfully mounted to the toner refilling portion 10 and rotated, together with the inlet shutter 14, to a position that will allow the plunger 93 to be pressed and the toner supplied to the toner refilling portion 10. Additionally, a user rotating the toner refill cartridge 9 may physically feel the interaction between the shutter protrusion 150 and the latching protrusion 161 and thus receive tactile feedback indicating that the toner refill cartridge 9 has been successfully mounted to the toner refilling portion 10 and rotated, together with the inlet shutter 14, to a position that will allow the plunger 93 to be pressed and the toner supplied to the toner refilling portion 10.

Upon the inlet shutter 14 being rotated past the latching protrusion 161, the inlet shutter 14 is in the inlet position and the toner inlet portion 120 is aligned with the toner discharging portion 940 of the toner refill cartridge 9 and offset from the blocking portion 140. By pressing the plunger 93 in this state, toner may be supplied from the body 91 to the toner container 230 through the toner discharging portion 940 and the toner inlet portion 120. When the toner refill cartridge 9 is mounted to the toner refilling portion 10 and the inlet shutter 14 is in a position other than the inlet position, the toner inlet portion 120 is closed such that the plunger 93 is prevented from pushing the toner through the toner discharge portion 940 out of the toner refill cartridge 9. Therefore, a user who does not receive the audible or tactile feedback as discussed above when rotating the toner refill cartridge 9, can avoid the inconvenience of an unsuccessful attempt of performing a plunging operation with the plunger 93. Therefore, according to the examples described herein the operation of the shutter protrusion 150 improves a user experience.

Moreover, the examples described herein utilize features of the toner refilling portion 10, such as the first latch member 16 and latching protrusion 161 or the second latch member 19 and latching portion 191, which are provided to the toner refilling portion 10 to perform other functions which have been described herein. Therefore, additional costs can be avoided by not utilizing or manufacturing additional parts to interact with the shutter protrusion 150 to produce the feedback to the user when rotating the toner refill cartridge 9 together with the inlet shutter 14.

Figure 25:
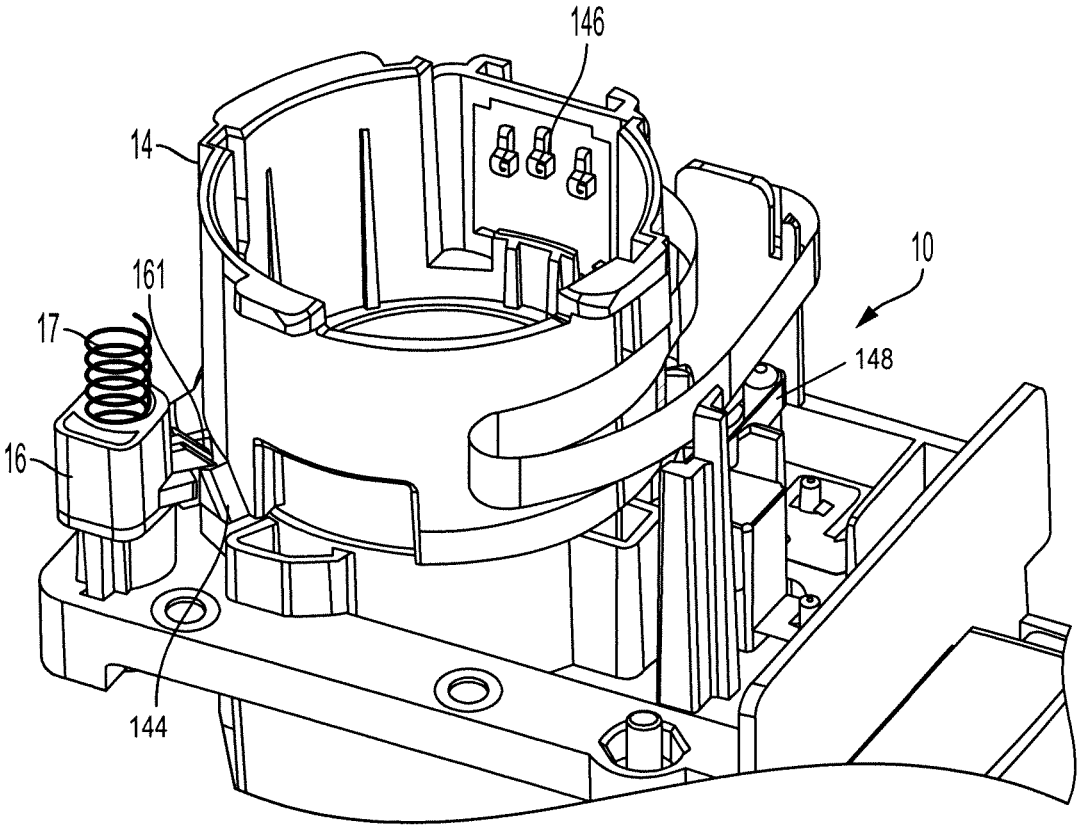
FIG. 25 is a partial perspective view of a toner refilling portion, according to an example.

A user may be provided feedback regarding whether the toner refill cartridge 9 is successfully mounted on the toner refilling portion 10 in a mechanical fashion as discussed above with respect to FIGS. 23-24D, as well as in an electrical fashion as discussed above with respect to FIGS. 5A-9. For example, as illustrated in FIG. 25, the toner refilling portion 10 may include an inlet shutter 14 having the shutter protrusion 150 (not shown but located at a position corresponding to 145 or 145-2 as illustrated in FIGS. 12 and 13 and diametrically opposite of 144) which mechanically interacts with the latching protrusion 161, and a first connector 146 that is electrically connectable to the electrical contact portion 961 of the connection interface 96 of the toner refill cartridge 9. The second connector 127 of the toner refilling portion 10 may transmit information about the toner refill cartridge 9 obtained through the first connector 146 to the controller 300 of the image forming apparatus 1000 and may transmit information about the development cartridge 2 obtained from the circuit unit 128 to the controller 300. For example, the information about the toner refill cartridge 9 obtained through the first connector 146 and transmitted to the controller 300 may include authentication information indicating the toner refill cartridge 9 is a genuine or authentic source of toner supply and has been inserted. Upon this authentication the a user may be allowed to rotate the toner refill cartridge 9. For example, the information about the development cartridge 2 obtained through the second connector 127 and transmitted to the controller 300 may include information regarding a position of the inlet shutter 14 when the inlet shutter 14 is rotated and the information about the toner refill cartridge 9 may include information regarding a position of the toner refill cartridge 9 when the toner refill cartridge 9 is rotated. As discussed above, the rotation detection sensor 148 may include contacts, for example electrodes, which are used to detect when the inlet shutter 14 enters a certain position as the inlet shutter 14 is rotated in conjunction with the toner refill cartridge 9. For example, the rotation detection sensor 148 may detect when the inlet shutter 14 is rotated with the toner refill cartridge 9 by 180 degrees.

Furthermore, the output device 1020 and/or user interface 1010 may provide information regarding the position of the inlet shutter 14 when the inlet shutter 14 is rotated based on the information received by the controller 300 from the toner refilling portion 10 as well as information regarding a position of the toner refill cartridge 9 when the toner refill cartridge 9 is rotated based on the information received by the controller 300. As explained above, the information may be in the form of a message may be presented on a screen of the user interface 1010, a light indication, haptic feedback presented through the user interface 1010, or a sound generated by an output device 1020 such as a speaker. The user interface 1010 and output device 1020 may be combined as a single device where the user interface 1010 includes the output device 1020 or vice versa.

By providing information to a user indicating a status of mounting of the toner refill cartridge 9 to the toner refilling portion 10, in a mechanical and/or electrical fashion, the user can be better informed and readily ascertain whether a plunging operation is ready to be performed to inject toner from the toner refill cartridge 9 to the toner refilling portion 10.

While various examples have been described with reference to the drawings, it will be understood that various changes in form and details may be made therein without departing from the spirit and scope as defined by the following claims.

What is claimed is:

1. A development cartridge mountable in an image forming apparatus, the development cartridge comprising:

a toner container portion to store toner;

a toner refilling portion to receive, from a toner refill cartridge mountable to the toner refilling portion, toner to be stored in the toner container portion, the toner refilling portion comprising:

an inlet shutter rotatable to an inlet position at which the toner refilling portion is to receive the toner from the toner refill cartridge, and a shutter protrusion provided on a surface of the inlet shutter to, while the inlet shutter is rotated, contact an object and cause feedback indicating the inlet shutter is rotated to the inlet position;

a first connector to be electrically connected to the toner refill cartridge when the toner refill cartridge is mounted to the toner refilling portion, and a second connector including a circuit unit, the second connector to, when the development cartridge is mounted to the image forming apparatus, transmit information about the toner refill cartridge obtained through the first connector to a controller of the image forming apparatus and to transmit information about the development cartridge obtained from the circuit unit to the controller, wherein the information about the development cartridge includes information regarding a position of the inlet shutter when the inlet shutter is rotated.

2. The development cartridge of claim 1, wherein:

the shutter protrusion has a ramp shape including a first portion inclined at a first angle, a second portion inclined at a second angle, and a third portion inclined at a third angle, and when the shutter protrusion is to contact the object, the object ascends along the first portion, descends along the second portion, and further descends along the third portion.

3. The development cartridge of claim 2, wherein the second angle is less steep than the third angle.

4. The development cartridge of claim 1, wherein the shutter protrusion is to contact the object when the toner refill cartridge is mounted to the development cartridge and the inlet shutter is rotated by a predetermined amount.

5. The development cartridge of claim 4, wherein the predetermined amount is 180 degrees or 90 degrees.

6. The development cartridge of claim 4, wherein when the toner refill cartridge is mounted to the development cartridge, the inlet shutter is to rotate together with rotation of the toner refill cartridge.

7. The development cartridge of claim 1, wherein the feedback indicating the inlet shutter is in the inlet position includes at least one of audible feedback or tactile feedback.

8. The development cartridge of claim 1, wherein the toner refilling portion further comprises:

a latch member to lock the inlet shutter in the inlet position at which the toner is capable of being received from the toner refill cartridge and in a blocking position at which the toner is prevented from being received from the toner refill cartridge, and a latching protrusion provided on a surface of the latch member which projects in a radial direction toward the inlet shutter, wherein the object corresponds to the latching protrusion.

9. The development cartridge of claim 8, wherein the toner refilling portion further comprises:

a movable member selectively raised and lowered to switch the latch member between a first position where the inlet shutter is locked from switching between the blocking position and the inlet position and a second position where the inlet shutter is allowed to switch between the blocking position and the inlet position, wherein the latch member is raised together with the raising of the movable member and lowered together with the lowering of the movable member, wherein when the shutter protrusion contacts the latching protrusion while the inlet shutter is rotated, the latch member and the movable member are initially upwardly lifted by the shutter protrusion, and wherein when the shutter protrusion contacts the latching protrusion at a predetermined point during a rotation of the inlet shutter, the latch member and the movable member are lowered.

10. The development cartridge of claim 1, wherein:

the toner refilling portion further includes comprises a toner inlet portion to selectively receive the toner from the toner refill cartridge when the toner refill cartridge is mounted to the toner refilling portion, the toner inlet portion being selectively opened and closed by rotation of the inlet shutter, when the toner refill cartridge is mounted to the toner refilling portion and the inlet shutter is rotated to the inlet position, the toner inlet portion is opened to be aligned with a toner discharge portion of the toner refill cartridge and a plunger of the toner refill cartridge is movable in a longitudinal direction to push the toner through the toner discharge portion out of the toner refill cartridge into the toner refilling portion, and when the toner refill cartridge is mounted to the toner refilling portion and the inlet shutter is in a position other than the inlet position, the toner inlet portion is closed such that the plunger is prevented from pushing the toner through the toner discharge portion out of the toner refill cartridge.

11. The development cartridge of claim 1, wherein:

the inlet shutter has a cylindrical shape, and the shutter protrusion is disposed on a lower outer circumferential surface of the cylindrical shape.

12. An image forming apparatus comprising:

a main body including a communicating portion formed in an exterior surface of the main body;

a photoconductor; and a development cartridge attachable to and detachable from the main body, the development cartridge to supply toner to an electrostatic latent image formed on the photoconductor for forming a toner image, wherein the development cartridge comprises:

a toner container portion; and a toner refilling portion to receive, from a toner refill cartridge mountable to the toner refilling portion, toner to be stored in the toner container portion, wherein the toner refill cartridge is mountable to the toner refilling portion via the communicating portion, and the toner refilling portion comprises:

an inlet shutter rotatable to an inlet position at which the toner refilling portion is to receive the toner from the toner refill cartridge, and a shutter protrusion provided on a surface of the inlet shutter to, while the inlet shutter is rotated, contact an object and cause a feedback indicating the inlet shutter is rotated to the inlet position;

a controller to receive information from the toner refilling portion regarding a position of the inlet shutter when the inlet shutter is rotated; and an output device to provide information regarding the position of the inlet shutter when the inlet shutter is rotated based on the information received by the controller from the toner refilling portion.

13. The image forming apparatus of claim 12, wherein the toner refilling portion further comprises:

a first connector to be electrically connected to the toner refill cartridge when the toner refill cartridge is mounted to the toner refilling portion, and a second connector including a circuit unit to, when the development cartridge is attached to the main body, transmit information about the toner refill cartridge obtained through the first connector to the controller and to transmit the information regarding the position of the inlet shutter when the inlet shutter is rotated to the controller.

14. The image forming apparatus of claim 13, wherein the output device includes at least one of a speaker, a display screen, or a light indicator.

15. The image forming apparatus of claim 12, wherein:

the shutter protrusion has a ramp shape including a first portion inclined at a first angle, a second portion inclined at a second angle, and a third portion inclined at a third angle, and when the shutter protrusion is to contact the object, the object ascends along the first portion, descends along the second portion, and further descends along the third portion.

16. The image forming apparatus of claim 15, wherein the second angle is less steep than the third angle.

17. The image forming apparatus of claim 12, wherein the shutter protrusion is to contact the object when the toner refill cartridge is mounted to the development cartridge and the inlet shutter is rotated by a predetermined amount.

18. The image forming apparatus of claim 12, wherein the feedback indicating the inlet shutter is in the inlet position includes at least one of audible feedback or tactile feedback.

19. The image forming apparatus of claim 12, wherein the toner refilling portion further comprises:

a latch member to lock the inlet shutter in the inlet position at which the toner is capable of being received from the toner refill cartridge and in a blocking position at which the toner is prevented from being received from the toner refill cartridge, and a latching protrusion provided on a surface of the latch member which projects in a radial direction toward the inlet shutter, wherein the object corresponds to the latching protrusion.

* * * * *